US010823492B2

(12) United States Patent
Oh

(10) Patent No.: US 10,823,492 B2
(45) Date of Patent: Nov. 3, 2020

(54) REFRIGERATOR

(71) Applicant: LG ELECTRONICS INC., Seoul (KR)

(72) Inventor: Changseok Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/545,604

(22) Filed: Aug. 20, 2019

(65) Prior Publication Data

US 2020/0072536 A1 Mar. 5, 2020

(30) Foreign Application Priority Data

Aug. 29, 2018 (KR) ..... 10-2018-0102318

(51) Int. Cl.

| | |
|---|---|
| ***A47B 96/04*** | (2006.01) |
| ***F25D 25/02*** | (2006.01) |
| ***F25D 23/06*** | (2006.01) |
| ***A47B 96/02*** | (2006.01) |

(Continued)

(52) U.S. Cl.

CPC ..... *F25D 25/024* (2013.01); *A47B 88/493* (2017.01); *A47B 96/025* (2013.01); *F25D 23/028* (2013.01); *F25D 23/067* (2013.01); *A47B 2210/0078* (2013.01)

(58) Field of Classification Search

CPC ... F25D 25/025; F25D 23/028; A47B 88/447; A47B 88/45; A47B 88/467; A47B 2210/0067; A47B 2210/007; A47B 2210/0078

See application file for complete search history.

(56) References Cited

U.S. PATENT DOCUMENTS 4,436,989 A * 3/1984 Schuldt ..... A47B 88/487 235/22
5,490,724 A * 2/1996 Domenig ..... A47B 88/467 312/333

(Continued)

FOREIGN PATENT DOCUMENTS

EP 3 358 282 A1 8/2018
KR 20130036674 A * 4/2013 ..... F25D 25/025

(Continued)

OTHER PUBLICATIONS

Extended European Search Report dated Feb. 6, 2020 issued in Application EP 19193822.4.

*Primary Examiner* — Matthew W Ing
(74) *Attorney, Agent, or Firm* — KED & Associates LLP

(57) ABSTRACT

A refrigerator includes a cabinet having an inner case and a drawer assembly installed on both side walls of the inner case. The pantry assembly includes a basket capable of being inserted and withdrawn from the storage chamber; a supporter assembly connected to the basket and guiding insertion and withdrawal of the basket; and a cover connected to the supporter assembly that moves in a direction opposite to the basket when the basket is inserted or withdrawn. The basket includes a first roller rotatably installed on both side walls thereof, and the supporter assembly includes a supporter having a guide rail that receives the first roller and a transmission unit for transmitting the moving force of the basket to the cover.

22 Claims, 17 Drawing Sheets

(51) Int. Cl.
*A47B 88/493* (2017.01)
*F25D 23/02* (2006.01)

(56) References Cited

U.S. PATENT DOCUMENTS

| | | | | | |
|---|---|---|---|---|---|
| 5,785,400 | A * | 7/1998 | Grieser | A47B 88/487 | 312/334.12 |
| 2002/0125802 | A1* | 9/2002 | Remmers | A47B 88/402 | 312/334.7 |
| 2004/0194253 | A1* | 10/2004 | Jung | F25D 23/02 | 16/87.2 |
| 2005/0145704 | A1* | 7/2005 | Hwang | F25D 17/045 | 236/44 A |
| 2010/0031468 | A1* | 2/2010 | Tomiji | E05F 5/027 | 16/52 |
| 2011/0219808 | A1 | 9/2011 | Oh | | |
| 2016/0341469 | A1* | 11/2016 | Hanson | F25D 25/025 | |
| 2017/0198963 | A1* | 7/2017 | Hanson | F25D 25/025 | |
| 2018/0283771 | A1* | 10/2018 | Shin | F16H 19/04 | |

FOREIGN PATENT DOCUMENTS

| | | | | |
|---|---|---|---|---|
| KR | 10-2017-0138321 | | 12/2017 | |
| WO | WO-2010121958 | A2 * | 10/2010 | F25D 25/025 |
| WO | WO-2014201615 | A1 * | 12/2014 | F25D 25/025 |
| WO | WO-2017057995 | A1 * | 4/2017 | F25D 23/02 |

* cited by examiner

REFRIGERATOR

CROSS-REFERENCE TO RELATED APPLICATION(S)

This application is based on and claims the benefit of priority to Korean Patent Application No. 10-2018-0102318, filed in Korea on Aug. 29, 2018, in the Korean Intellectual Property Office, the disclosure of which is incorporated herein in its entirety by reference.

BACKGROUND

1. Field

The present disclosure relates to a refrigerator.

2. Background

A refrigerator may be a household appliance which can store food in an internal storage space which is shielded by a door at low temperatures, and the refrigerator may store the food in an optimal state by cooling an inside of the storage space using cold air generated by heat exchange with a refrigerant circulating in a refrigeration cycle. Such a refrigerator may be large-sized and multifunctional as dietary life is changed and taste of a user is diversified and the refrigerator which has various storage spaces for the user's convenience and has a convenience device is released.

Korean Patent Laid-Open Publication No. 10-2017-0138321, which is a related art, discloses a refrigerator. The refrigerator of the related art includes a cabinet in which a storage space is formed, a pantry assembly provided in the storage space and forming a receiving space for a separate food, and a shielding member which is provided on the pantry assembly and shields a portion of the upper surface of the pantry assembly.

The pantry assembly includes a pair of support members disposed on both sides of the storage space, a receiving member provided between the pair of support members to pull in and out along the support member, a cover member which shields a portion of an opened upper surface of the receiving member and is moved in a direction opposite to a moving direction of the receiving member by being interlocked with pulling-in and out operations of the receiving member, and a drive unit which is provided on the support member and connects so that the receiving member and the cover member are interlocked with each other.

The drive unit includes a second gear assembly coupled to the receiving member and moved in the same direction as the receiving member when the receiving member is pulled in and out, a first gear member coupled to the cover member and moved in the same direction as the cover member; a connecting gear rotatably provided between the second gear assembly and the first gear assembly and connecting the second gear assembly and the first gear member; and an elastic member for forcing the receiving member to be pulled in in a state where the receiving member and the second gear assembly are coupled. According to the related art, a user has to apply a force greater than the elastic force of the elastic member and the load of the receiving member in order to pull the receiving member.

When the elastic force of the elastic member is increased, while a force by which a user pulls the receiving member is increased to make it difficult to open the receiving member, the receiving member is easily returned to the original position thereof by the elastic member in a process of pushing the receiving member in order to return the receiving member to an original position thereof. However, in a case where the elastic force of the elastic member is large, there is a disadvantage that the collision noise is large in a process of returning the receiving member to the original position.

On the other hand, when the elastic force of the elastic member is small, a force to pull the receiving member is required to be small. However, there is a disadvantage that the load of the receiving member is larger than the force that the elastic member pulls the receiving member in a process of pushing the receiving member in order to return the receiving member to the original position thereof, so that the receiving member cannot be completely returned to the original position thereof only by the elastic force of the elastic member.

BRIEF DESCRIPTION OF THE DRAWINGS

Embodiments will be described in detail with reference to the following drawings in which like reference numerals refer to like elements, and wherein.

DETAILED DESCRIPTION

Figure 1:
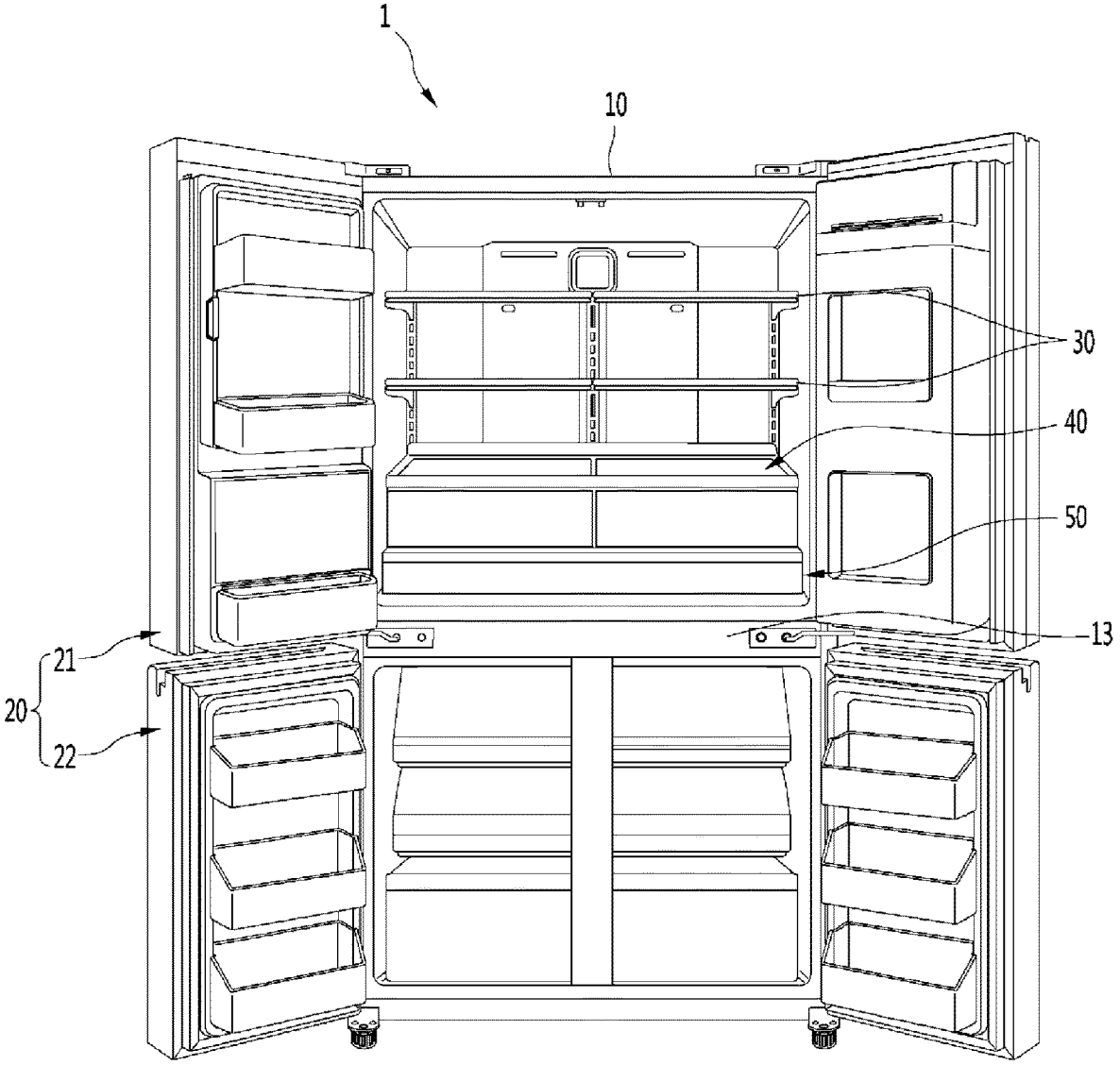
FIG. 1 is a perspective view illustrating a refrigerator in a state where a refrigerator door is opened according to an embodiment of the present disclosure.
Figure 2:
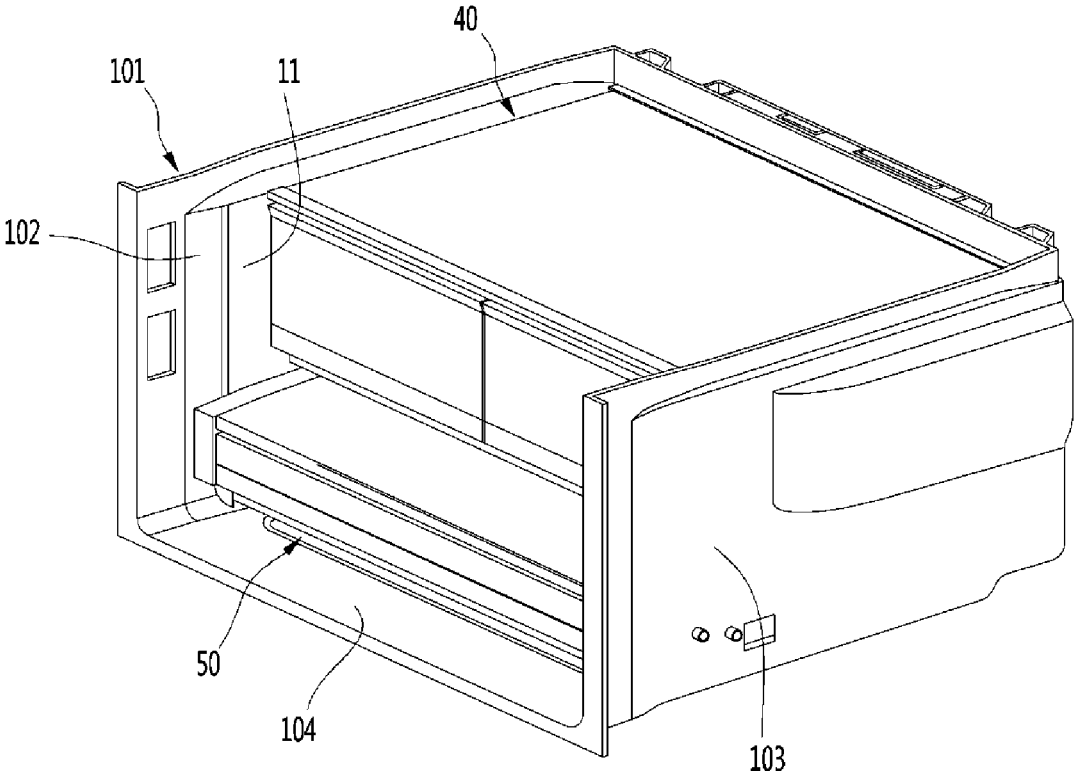
FIG. 2 is a perspective view illustrating a pantry assembly in the refrigerating chamber and an upper drawer assembly.
Figure 3:
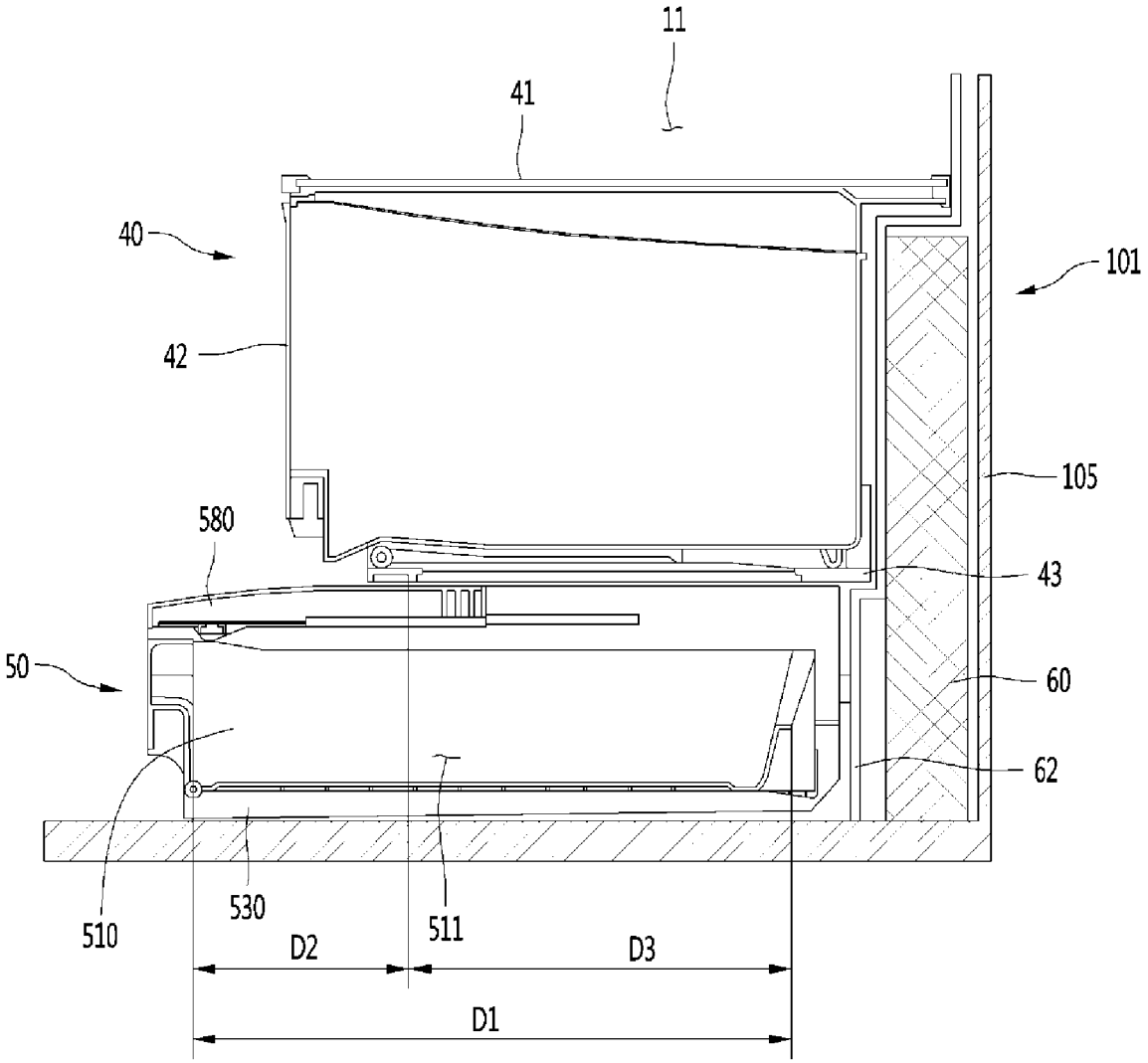
FIG. 3 is a side view illustrating a disposition of the pantry assembly and a drawer assembly of FIG. 2.

Referring to FIGS. 1 to 3, a refrigerator 1 according to an embodiment of the present disclosure may include a cabinet 10 that forms a storage chamber, and a refrigerator door 20 for opening and closing the cabinet 10. The storage chamber may be partitioned into a refrigerating chamber 11 and a freezing chamber 12 by the partitioning portion (or partition) 13 in the cabinet 10. In FIG. 1, as an example, the freezing chamber 12 is located below the refrigerating chamber 11, but the present disclosure is not limited thereto.

The refrigerator door 20 may include a refrigerating chamber door 21 for opening and closing the refrigerating chamber 11 and a freezing chamber door 22 for opening and closing the freezing chamber 12. Although not limited, a pair of refrigerating chamber doors 21 arranged on the left and right sides may open and close the refrigerating chamber 11.

In addition, a pair of freezing chamber doors 22 arranged on the left and right sides may open and close the freezing chamber 12. The storage chamber may include a pantry assembly (or first drawer assembly) 50 in which a food receiving space is exposed forward by pulling-in and out. In the pantry assembly 50, a receiving space having an area larger than a pulled-out area may be exposed to the outside when the pantry assembly 50 is pulled out.

The position where the pantry assembly 50 is provided is not limited, but the following description will be made about the disposition of the pantry assembly 50 in the refrigerating chamber 11. The pantry assembly 50 may be positioned at the lowermost portion of the refrigerating chamber 11. A width of the pantry assembly 50 may be substantially the same as a width of the refrigerating chamber 11.

The cabinet 10 may include an inner case 101 that forms the refrigerating chamber 11. The inner case 101 may include a pair of side walls 102 and 103 spaced left and right and a bottom wall 104 connecting the pair of side walls 102 and 103. The pantry assembly 50 may be fixed to the pair of side walls 102 and 103.

The pantry assembly 50 may include a receiving member (or basket) 510 forming a receiving space 511, a supporter assembly connected to the receiving member 510 and guiding the pulling-in and out of the receiving member 510, and a cover member (or cover) 580 connected to the supporter assembly and opening and closing the receiving space 511 being interlocked with the basket 510.

The supporter assembly may include a pair of supporters 530 connected to the basket 510 to support the basket 510. The pair of supporters 530 may be installed on each of the pair of side walls 102 and 103.

The cover 580 may cover a portion of the receiving space 511. A second drawer assembly 40 may be positioned above the cover 580. At least one shelf 30 may be provided above the second drawer assembly 40 in the refrigerating chamber 11. Food may be placed on the shelf 30.

The evaporator 60 may be positioned in front of the rear wall 105 in the inner case 101 and the evaporator 60 may be covered by a cool air duct 62 to supply cool air to the refrigerating chamber 11. The second drawer assembly 40 and the pantry assembly 50 may be positioned in front of the cool air duct 62 to receive cool air.

The second drawer assembly 40 may include a drawer 42 which forms a receiving space and can be pulled out forward, a drawer supporter 43 which supports a lower side of the drawer 42, and a drawer cover 41 covering the upper side of the drawer 42. The drawer supporter 43 may be fixed to the inner case 101 and may cover a portion of the upper side of the basket 510.

Therefore, in the present embodiment, the cover 580 is a movable cover, and the drawer supporter 43 may be a fixed cover which is kept in a fixed state. In addition, food may be placed on the drawer cover 41, and the drawer cover 41 may function as the shelf 30.

The maximum length of the receiving space 511 of the basket 510 in the front and rear direction is D1. As illustrated in FIG. 3, the cover 580 may cover a portion of the receiving space 511 when the basket 510 is fully inserted. For example, the cover 580 may cover the front space of the receiving space 511 with respect to the front and rear of the receiving space 511.

The front and rear length of the space covered by the cover 580 of the receiving space 511 may be D2 and the front and rear length of the space which is not covered by the cover 580 may be D3. D3 may be larger than D2. The space which is not covered by the cover 580 may be covered by the drawer supporter 43.

The front and rear length of the drawer supporter 43 may be longer than the front and rear length of the cover 580. The cover 580 and the drawer supporter 43 may overlap in the vertical direction when the basket 510 is fully inserted.

Figure 4:
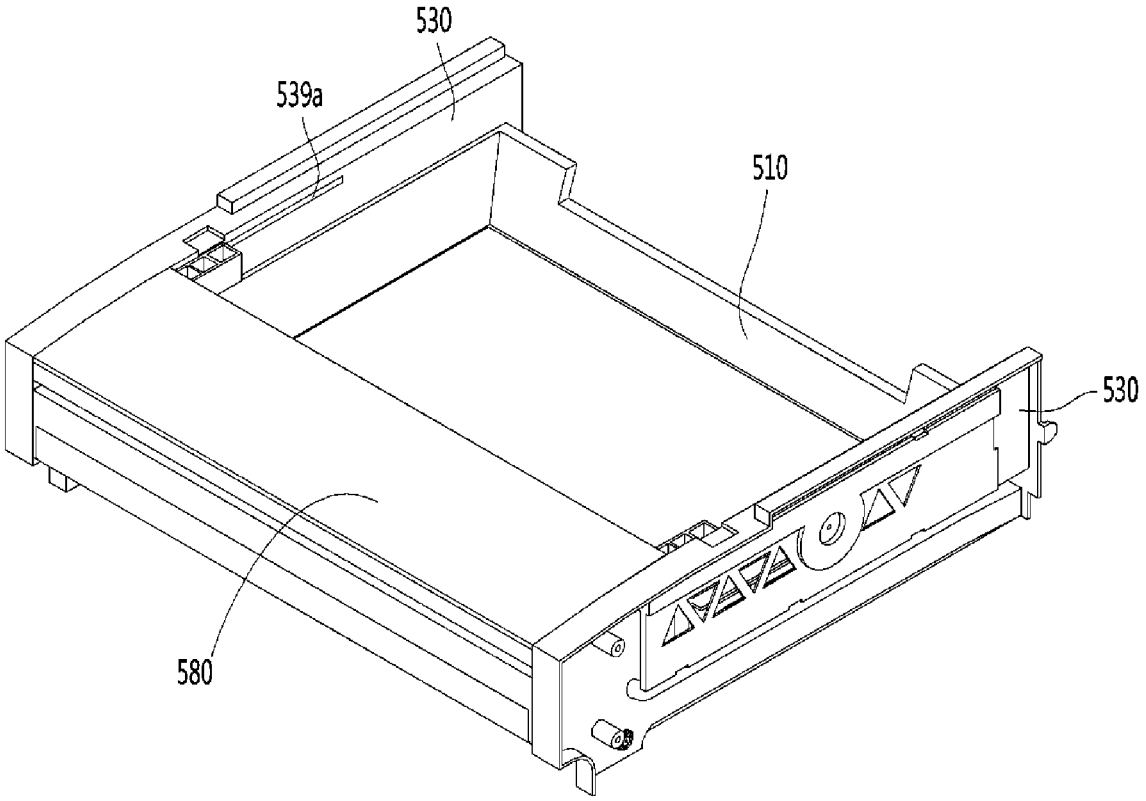
FIG. 4 is a perspective view illustrating the pantry assembly according to an embodiment.
Figure 5:
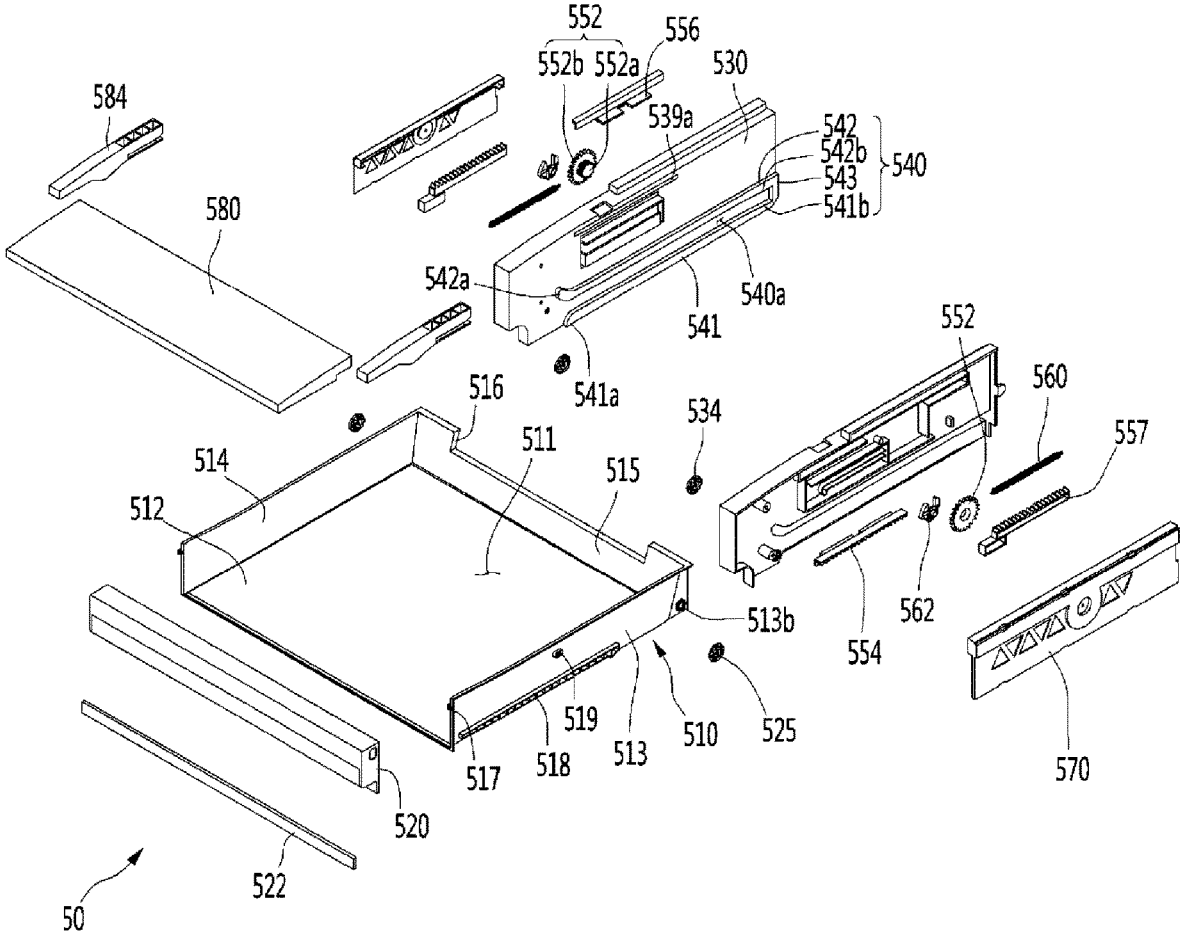
FIG. 5 is an exploded perspective view illustrating the pantry assembly of FIG. 4.
Figure 6:
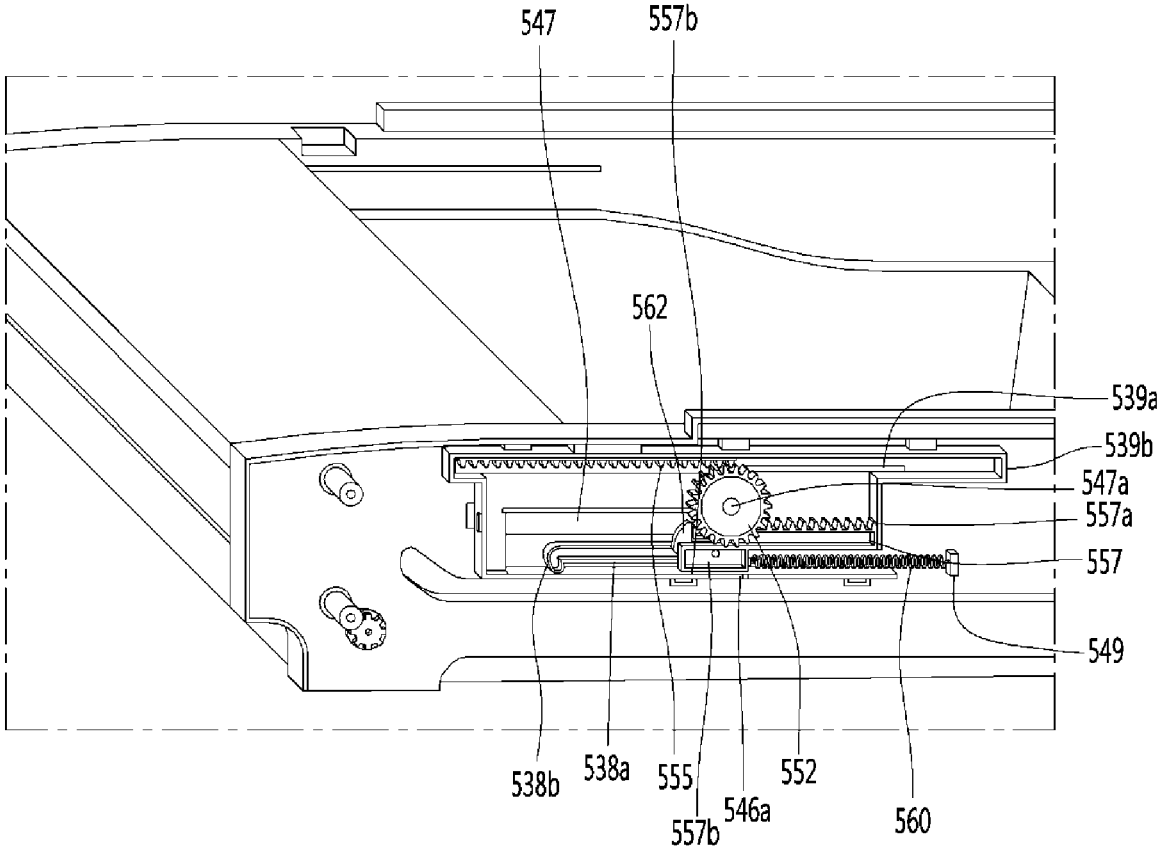
FIG. 6 is a perspective view illustrating a state where a side cover is separated from the pantry assembly of FIG. 4.

Referring to FIGS. 4 to 6, the basket 510 may form the receiving space 511. The basket 510 may be formed in a rectangular parallelepiped shape having an opened top surface.

The basket 510 may include a bottom wall 512, a pair of side walls 513 and 514 extending upward from both side ends of the bottom wall 512, and a rear wall 515 connecting rear ends of a pair of side walls 513 and 514. The basket 510 may further include a front opening 517 and the front opening 517 may be covered by a front cover 520 coupled to the front surface of the basket 510. A deco cover 522 may be coupled to a lower portion of the front cover 520.

A cool air slot 516 for passing cool air may be formed in the rear wall 515 of the basket 510. The cool air slot 516 may be formed when the upper end of the rear wall 515 is recessed downward.

Each of the pair of side walls 513 and 514 of the basket 510 may include a guide protrusion 518 extending in the front and rear direction. The guide protrusions 518 may extend rearward from the front end portion of each of the side walls 513 and 514 and extend to a position spaced apart from the rear ends of the side walls 513 and 514 by a predetermined distance. The length of the guide protrusion 518 may be determined in consideration of a distance for pulling out the basket 510.

A first roller supporter 513*b* to which the first roller 525 is coupled may be formed on each of the side walls 513 and 514 of the receiving member 510.

The first roller supporter 513*b* may be positioned behind the guide protrusions 518 at the respective side walls 513 and 514. In other words, the first roller supporter 513*b* may be positioned behind the guide protrusion 518 and may be formed on a position adjacent to the rear ends of each of the side walls 513 and 514.

The pair of supporters 530 may support the basket 510 and may guide the sliding of the basket 510. The guide rails 540 for guiding the first roller 525 of the basket 510 may be provided on the surfaces of the pair of supporters 530 facing each other.

The guide rails 540 may protrude from the respective supporters 530 to receive the first rollers 525. At this time, the guide rails 540 may protrude in a direction approaching each other at the respective supporters 530. The guide rail 540 may include a first guide portion (or bottom rail) 541 and a second guide portion (or top rail) 542 spaced apart from the first guide portion 541 above the first guide portion 541.

A space 540*a* may be formed between the first guide portion 541 and the second guide portion 542 and the first roller 525 may rotate in a state of being received in the space 540*a*, and may move along the guide rails 540. The vertical length between the first guide portion 541 and the second guide portion 542 may be equal to or larger than the diameter of the first roller 525.

The first roller 525 may move along the upper surface of the first guide portion 541 while rotating when the basket 510 is pulled in and out, in a state where the first roller 525 is seated on the upper surface of the first guide portion 541. Each of the guide portions 541 and 542 may include an inlet inclined portion 541*a* and 542*a* inclined in a direction away from each other, such that the first roller 525 of the basket 510 may be easily inserted into the space 540*a* of the guide rail 540 during the assembling process.

When the basket 510 is pulled, each of the guide portions 541 and 542 may include inclined surfaces 541*b* and 542*b* inclined downward toward the rear side, so that the basket 510 may be easily moved to the pulling-in completion position. When the first roller 525 is positioned on one of the inclined surfaces 541*b* and 542*b* while moving along the upper surface of the first guide portion 541, the first roller 525 may be inclined downward, and according to this, the basket 510 to which the first roller 525 is connected may be inclined downward to move to the fully inserted position.

The rear end portion of the first guide portion 541 and the rear end portion of the second guide portion 542 may be connected by a connection portion 543. The first roller 525 may remain in contact with the inclined surfaces 541*b* and 542*b* when the basket 510 is fully inserted. The first roller 525 may be in contact with the connection portion 543. Accordingly, the connection portion 543 may serve as a stopper for stopping the basket 510 when the basket 510 is fully inserted.

Each of the side walls 513 and 514 of the basket 510 may include a transmission protrusion 519 for transmitting the movement force of the basket 510 to the cover 580. The transmission protrusions 519 may be positioned above the guide protrusions 518 and may be approximately positioned at a central portion in the front and rear direction of the respective side walls 513 and 514.

When the basket 510 is slid in the first direction (i.e., drawn out) the cover 580 may slide in a second direction opposite to the first direction so that the receiving space 511 of the basket 510 is opened. The cover 580 may be moved by receiving the movement force of the basket 510.

Therefore, the supporter assembly may further include a transmission unit for transmitting the movement force of the basket 510 to the cover 580. The transmission unit may be supported by the supporter 530 and may be connected to the cover 580.

The transmission unit may transmit the movement force of the basket 510 to the cover 580 in some sections in a process of pulling in the basket 510 and may not transmit the moving force of the basket 510 to the cover 580. For example, the transmission unit may transmit the movement force of the basket 510 to the cover 580 until the basket 510 is drawn out by a predetermined distance from the fully inserted position.

When the basket 510 is inserted by a distance greater than the predetermined distance from the fully inserted position, the transmission unit may block that the movement force of the basket 510 is transmitted to the cover 580. The transmission unit may include a connection member (or connection hook) 562 which may be connected to the transmission protrusion 519 of the basket 510, a first rack 557 to which the connection member 562 is rotatably connected, a transmission gear 552 connected to the first rack 557, and a second rack 554 connected to the transmission gear 552 and coupled to the cover 580.

The transmission unit may be covered by a unit cover (or cover plate) 570. The cover plate 570 may be coupled to the supporter 530. The cover plate 570 may be positioned in a direction opposite to the guide rail 540 with respect to the supporter 530 to cover the transmission unit. In addition, the transmission unit may further include an elastic member (or spring) 560 connected to the first rack 557.

The first rack 557 may include a first rack gear portion (or first rack gear) 557*a* connected to the transmission gear 552, as a straight rack moving in a linear direction. The gears or teeth of the first rack gear 557*a* may face upward. The first rack 557 may further include a coupling body 557*b* which may be bent downward from the first rack gear portion 557*a* and to which the coupling member 562 may be coupled.

The connection member 562 may be rotatably connected to the coupling body 557*b*. One end of the elastic member 560 may be connected to the coupling body 557*b*. The supporter 530 may have a fixing portion 549 to which the other end of the elastic member 560 is connected.

The elastic member 560 may be a coil spring, for example and may extend in the horizontal direction in a state where the elastic member 560 is connected to the coupling body 557*b* and the fixing portion 549. The elastic member 560 may accumulate elastic force in a process of pulling out the basket 510 and provide an elastic force to the basket 510 in a process of pulling the basket 510, thereby assisting the pulling-in of the basket 510.

The transmission gear 552 may be a multi-stage gear. In other words, the transmission gear 552 may include a first gear 552*a* having a first diameter, and a second gear 552*b* having a second diameter larger than the first diameter. The first gear 552*a* and the second gear 552*b* may be pinion gears whose rotational centers coincide with each other. The rotation center line of the transmission gear 552 may extend in the horizontal direction.

The first gear 552*a* may be engaged with the first rack 557. For example, the first gear 552*a* may be connected to the first rack gear 557*a* at an upper side of the first rack gear 557*a*.

This may reduce the lateral thickness in the horizontal direction by the transmission unit. As the lateral thickness of the transmission unit in the horizontal direction increases, since the volume of the basket 510 decreases, the volume reduction amount of the basket 510 can be minimized by reducing the thickness of the transmission unit in the horizontal direction.

The second rack 554 may include a second rack gear portion (or second rack gear) 555 which engages with the second gear 552*b* as a linear rack which moves in a linear direction. The second rack gear 555 may be engaged with the second gear 552*b* on the upper side of the second gear 552*b*. This may reduce the lateral thickness in the horizontal direction by the transmission unit.

The gear ratio of the first gear 552*a* and the second gear 552*b* may be, for example, 1:2. Therefore, the length of the second rack gear portion 555 may be longer than the length of the first rack gear portion 557*a*. According to the present embodiment, the cover 580 may be moved by a length longer than the moving length of the basket 510, so that the opening area of the receiving space 511 of the basket 510 may be increased.

The basket 510 may be positioned on one side of the supporter 530 and the transmission unit may be positioned on the other side of the supporter 530. This may prevent the transmission unit from being exposed in a process of pulling in and out the basket 510. Since the basket 510 and the transmission unit may be positioned opposite to each other with respect to the supporter 530, so that the transmission protrusion 519 of the basket 510 may be connected to the transmission unit, the supporter 530 may include a protrusion slot 547 through which the transmission protrusion 519 passes.

The protrusion slot 547 may extend in the longitudinal direction of the supporter 530. At this time, the longitudinal direction is the front and rear direction of the supporter 530. The supporter 530 may further include a gear shaft 547*a* for rotatably supporting the transmission gear 552. The gear shaft 547*a* may be positioned above the protrusion slot 547.

The supporter 530 may further include a first rack guide 546*a* for guiding the movement of the first rack 557 in a state of supporting the lower side of the first rack 557. For example, the coupling body 557*b* may be supported by the first rack guide 546*a*. The supporter 530 may further include a rack slot 539*a* through which the second rack 554 passes.

The second rack 554 may further include a cover coupling rib 556 extending in the horizontal direction. The cover coupling rib 556 may pass through the rack slot 539*a*.

The rack slot 539*a* may extend in a direction (for example, front and rear direction) parallel to the moving direction of the second rack 554 so as not to interfere with the cover coupling rib 556 of the second rack 554 which linearly moves.

The supporter 530 may further include a stopper 539*b* for restricting the movement of the second rack 554 in a process of pulling in the basket 510. The stopper 539*b* may be located behind the second rack 554 and when the cover 580 opens the receiving space 511 in a process of pulling out the basket 510, the cover 580 may be stopped by restricting the movement of the second rack 554. The position at which the cover 580 is stopped may be substantially the opening completion position of the cover member 580.

The supporter 530 may further include a guide slot for guiding the movement of the connection member 562. The guide slot may be a groove shape formed by being recessed in the supporter 530. The guide slot may include a first slot 538*a* for guiding the linear movement of the connection member 562 and a second slot 538*b* which is bent at the front end of the first slot 538*a* and extends downward.

The first slot 538*a* may have a linear shape. The second slot 538*b* may extend inclinedly at a front end of the first slot 538*a* and extend inclinedly rearward at the first slot 538*a*. As will be described later, the connection member 562 may move along the first slot 538*a* and may be rotated in a process of moving from the front end portion of the first slot 538*a* toward a side of the second slot 538*b*.

A connection frame 584 may be coupled to both sides of the cover 580. The connection frame 584 may be connected to the transmission unit to receive the movement force of the basket 510 through the transmission unit. The connection frame 584 may prevent the cover 580 from being damaged in a process of receiving the movement force of the basket 510.

The cover 580 may have the shape of a thin plate. When the cover 580 is directly connected to the transmission unit, the cover 580 may be broken in a process of transmitting the moving force to the cover 580, but, according to the present embodiment, this phenomenon may be prevented.

Figure 7:
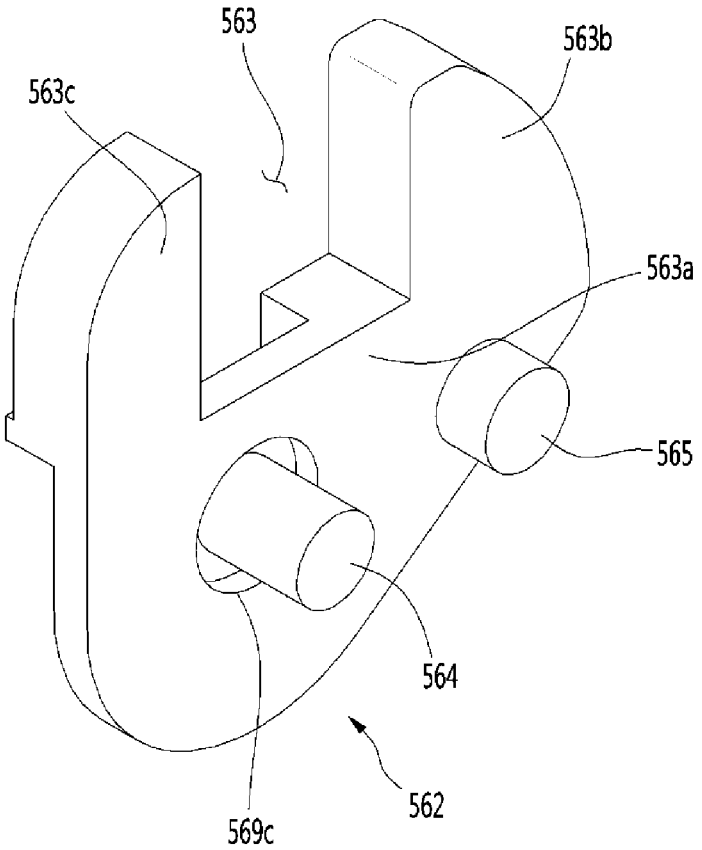
FIG. 7 and FIG. 8 are perspective views illustrating a connection member according to an embodiment.
Figure 8:
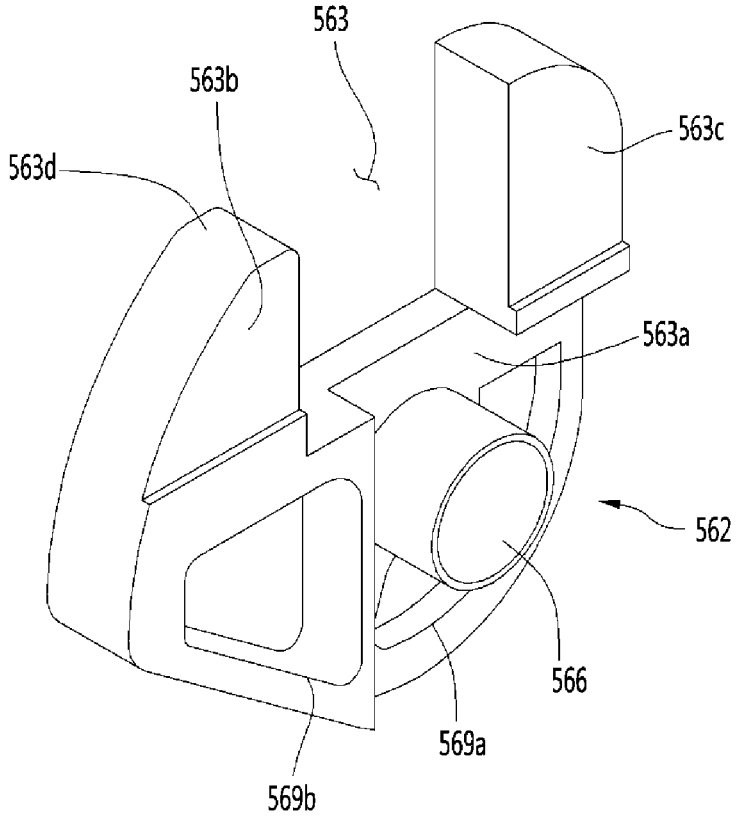

Referring to FIGS. 7 and 8, the connection member 562 may include a space portion (or notch) 563 formed by a portion of the upper surface thereof being recessed downward. The notch 563 may receive the transmission protrusion 519 of the basket 510.

The connection member 562 may include a front body 563*b* forming the notch 563, a rear body 563*c* spaced apart from the front body 563*b*, and a lower body 563*a* forming a bottom of the notch 563. Therefore, the transmission protrusion 519 may be received in the notch 563 between the front body 563*b* and the rear body 563*c*.

A first protrusion 564 and a second protrusion 565 which are spaced apart from each other in the horizontal direction may be provided on one surface of the lower body 563*a*. The first protrusions 564 and the second protrusions 565 may be arranged in a direction parallel to the linear movement direction of the connection member 562, for example.

The first protrusion 564 may overlap with the notch 563 in the vertical direction. The second protrusion 565 may be positioned in front of the first protrusion 564 and may not overlap with the notch 563 in the vertical direction.

A rack coupling shaft 566 for coupling with the first rack 557 may be provided on the other surface of the lower body 563*a*. For example, the rack coupling shaft 566 may be rotatably coupled to the coupling body 557*b* of the first rack 557. To this end, the rack coupling shaft 566 may be formed in a cylindrical shape so as to protrude from the other surface of the lower body 563*a* and so that the connection member 562 may be rotatable with respect to the first rack 557.

The rack coupling shaft 566 may be positioned on the opposite side of the first protrusion 564 with respect to the lower body 563*a*. In other words, the first protrusion 564 may overlap with the rack coupling shaft 566 in the lateral horizontal directions.

The first protrusion 564 and the second protrusion 565 may be received in the guide slot. For example, the first protrusion 564 and the second protrusion 565 may be located in the first slot 538*a* at the pulling-in completion position of the receiving member 510. The positional relationship of the first protrusion 564 and the second protrusion 565 in the guide slot in a process of pulling in the receiving member 510 will be described later with reference to the drawings.

The lower body 563*a* may further include reinforcing grooves 569*a*, 569*b*, and 569*c* which are recessed so as to increase the strength of the lower body 563*a* while reducing the weight of the connection member 562. Although not limiting, one reinforcing groove 569*a* may be positioned around the rack coupling shaft 566. In addition, another reinforcing groove 569*c* may be disposed around the first protrusion 564.

Figure 9:
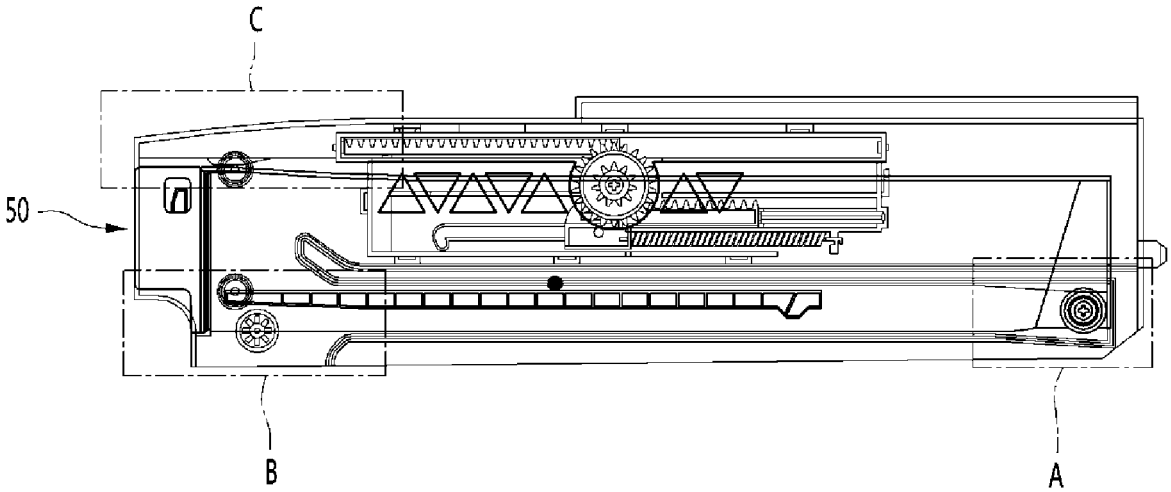
FIG. 9 is a side view illustrating a pantry assembly according to an embodiment.
Figure 10:
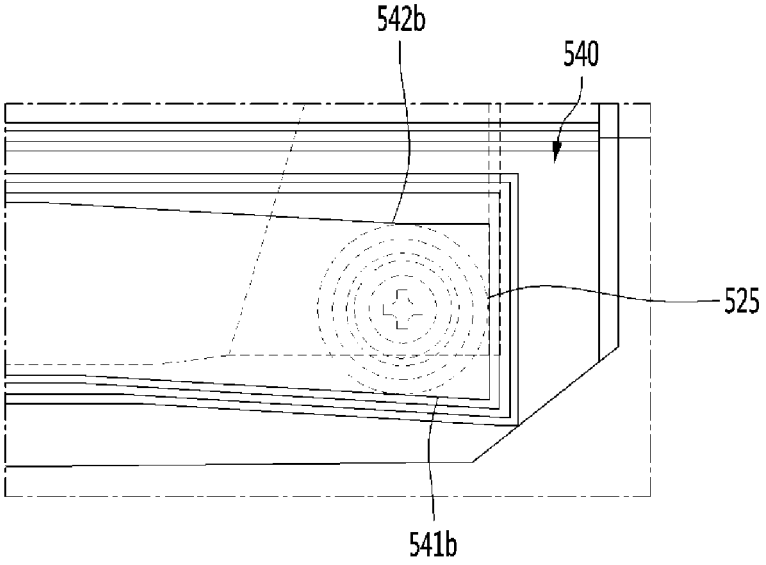
FIG. 10 is an enlarged view illustrating portion A in FIG. 9.

First, referring to FIGS. 9 and 10, the elastic force of the elastic member 560 may pull in the basket 510, thereby allowing the basket 510 to be automatically be pulled in. In the present embodiment, "automatic pull-in" means that the basket 510 may be pulled in even if the user removes the pushing force of the basket 510.

When the elastic force (elastic modulus) of the elastic member 560 is increased as described above, the basket 510 may be automatically moved to the pulling-in completion position in a specific section in a process in which the basket 510 is pulled in. However, a collision noise may be generated in a process in which the basket 510 reaches the pull-in completion position. In addition, a force required by the user in the process of pulling out the basket 510 may be large.

Therefore, the pantry assembly 50 may further include a pulling-in guide structure which compensates for problems when using the elastic member 560. Due to the above-described pulling-in guide structure, a small amount of force is required in a process of pulling in the basket 510, and the collision noise in the pulling-in process can be reduced.

The pulling-in guide structure may include the inclined surfaces 541*b* and 542*b* of the guide rail 540 as described above. When the first roller 525 of the basket 510 moves to the space between the inclined surfaces 541*b* and 542*b* while moving along the upper surface of the first guide portion 541, the roller 525 may be rotated while being inclined downwardly by the inclined surfaces 541*b* and 542*b* so that the basket 510 may be stably and automatically moved to the pulling-in completion position.

The inclined surfaces 541*b* and 542*b* of the guide rail 540 may be inclined downward with respect to the pulling-in direction of the basket 510. Therefore, when the basket 510 is pulled out, the first roller 525 may be lifted along the inclined surfaces 541*b* and 542*b*.

Since the first roller 525 may be positioned on the rear end portion of the side walls 513 and 514 of the basket 510, although the first roller 525 is lifted along the inclined surfaces 541*b* and 542*b*, the front portion of the basket 510 may not be lifted due to the load of the basket 510. In this case, when the basket 510 linearly moves in an inclined state without being linearly moved in a horizontal direction, the load of the basket 510 may act as a moment of the first rack 557 and thus the basket 510 may not be smoothly pulled in and out.

Figure 11:
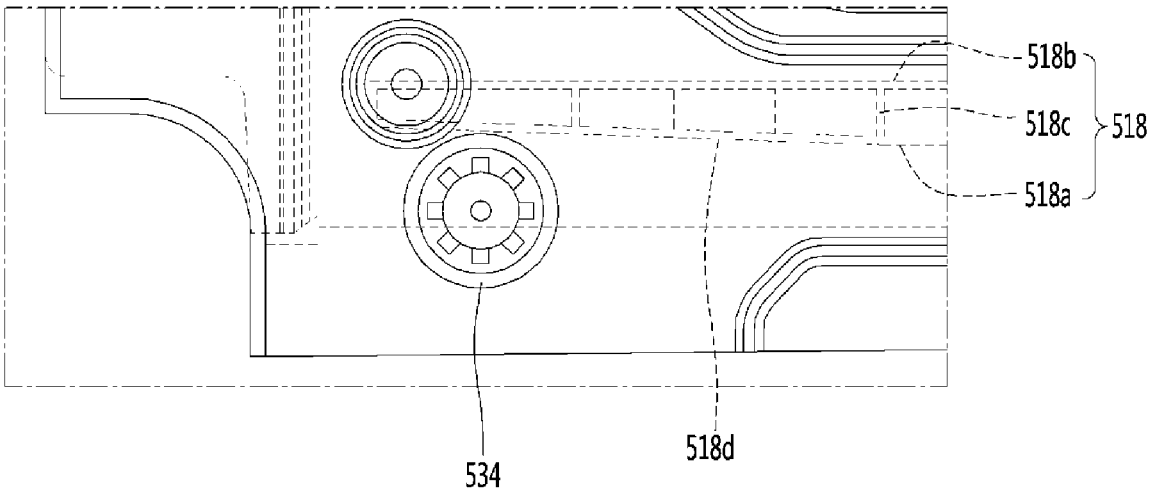
FIG. 11 is an enlarged view illustrating portion B in FIG. 9.

Therefore, the present embodiment may further include a horizontal keeping structure which may be lifted or lowered in a state the basket 510 forms a horizontal state when the first roller 525 is lifted or lowered along the inclined surfaces 541*b* and 542*b*. Specifically, referring to FIGS. 9 and 11, the supporter 530 may include a second roller 534 for supporting the guide protrusion 518 of the basket 510.

The second roller 534 may be installed on surfaces facing each other in a pair of supporters 530. The second roller 534 may be positioned in front of the guide rail 540 in the supporter 530. The second roller 534 may be in contact with the lower surface of the guide protrusion 518 and may rotate by friction with the guide protrusion 518 in a process of pulling-in and out the basket 510, and thus facilitating the pulling-in and out of the basket 510.

The guide protrusion 518 may include a lower rib 518*a*, an upper rib 518*b* positioned above the lower rib 518*a*, and a plurality of connection ribs 518*c* which connect the lower rib 518*a* and the upper rib 518*b* to each other. The lower rib 518*a* may be in contact with the second roller 534 in a process of pulling-in and out the basket 510.

The upper rib 518*b* may extend in a linear shape in the horizontal direction. A portion of the lower rib 518*a* may extend in a straight line in the horizontal direction and may be parallel to the upper rib 518*b*. The other portion of the lower rib 518*b* may be inclined upward toward the front. The lower rib 518*a* may include an inclined rib 518*d*. In other words, the horizontal keeping structure may include the inclined ribs 518*d*.

At this time, the inclination angle of the inclined ribs 518*d* may be the same as the inclination angle of the inclined surfaces 541*b* and 542*b* of the guide rails 540. The front end portion of the inclined rib 518*d* may be connected to the upper rib 518*b*. The inclined ribs 518*d* and the upper ribs 518*b* may be connected by one or more connection ribs 518*c*. Therefore, when the first roller 525 is lifted or lowered along the inclined surfaces 541*b* and 542*b*, the front side of the basket 510 may be lifted or lowered together by the inclined ribs 518*d*.

Figure 12:
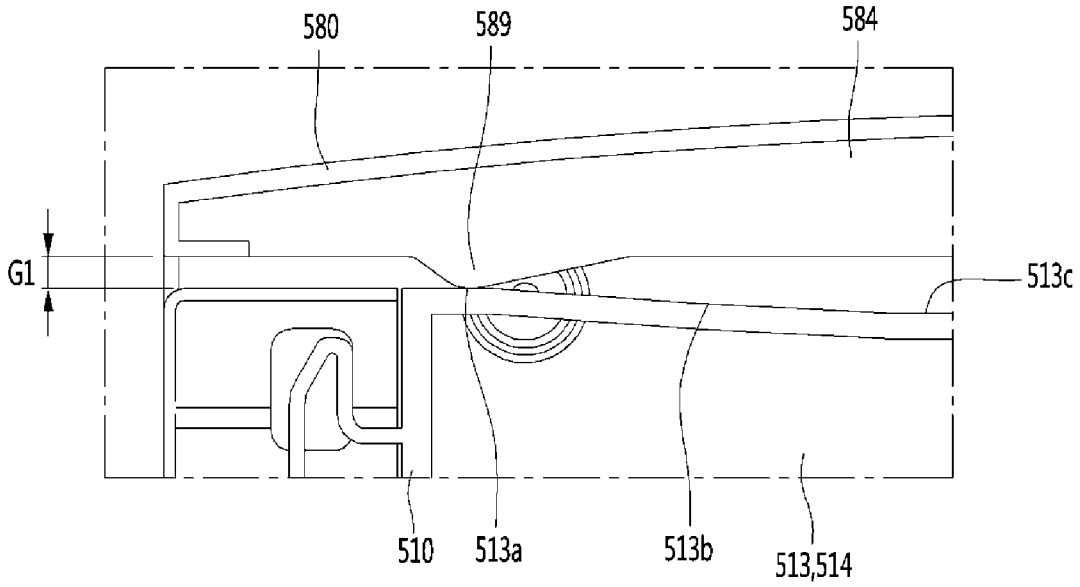
FIG. 12 is an enlarged view illustrating portion C in FIG. 9.

Next, referring to FIGS. 9 and 12, the cover 580 or the connection frame 584 may include a spacer rib 589 protruding downward. For example, the spacer ribs 589 may protrude downward from the connection frame 584.

The spacer rib 589 may be in contact with the upper surfaces of the side walls 513 and 514 of the basket 510 at the fully inserted position of the basket 510. For example, the spacer ribs 589 may be in contact with a side of the front end portion of the upper surface of the side walls 513 and 514.

The cover 580 and the upper surface of the basket 510 may be spaced apart from each other by the spacer ribs 589 at the fully inserted position of the basket 510. In other words, a gap G1 may exist between the cover 580 and the basket 510. The gap G1 may allow the refrigerating chamber 11 and the receiving space 511 of the basket 510 to communicate with each other at the fully inserted position of the basket 510. Therefore, cold air may circulate through the receiving space 511 and the refrigerating chamber 11.

The refrigerator 1 may further include a temperature sensor for sensing the temperature of the receiving space 511. The amount of cool air supplied to the receiving space 511 may be determined based on the temperature sensed by the temperature sensor.

In a case where there is no gap between the cover 580 and the basket 510, since the cool air may stagnate in the receiving space 511 and the temperature sensed by the temperature sensor may be lowered, the cold air may not be allowed to flow into the basket 510. When the temperature of the receiving space 511 sensed by the temperature sensor increases, cool air may be supplied to the receiving space 511.

As described above, when the cold air supply and supply interruption are repeated, the temperature change width of the food stored in the receiving space 511 may become large, and the freshness of the food may become low. On the other hand, according to the present embodiment, since the receiving space 511 and the refrigerating chamber 11 communicate with each other by the gap G1 existing between the cover 580 and the basket 510 and thus the cool air can be circulated, the temperature change width of the food stored in the receiving space 511 may be minimized and freshness may be kept.

In a case of the present embodiment, the basket 510 may be lifted by the inclined surfaces 541*b* and 542*b* and the inclined ribs 518*d* in a process of pulling-out of the basket 510. In a case where the sidewalls 513 and 514 of the basket 510 have the same height, the sidewalls 513 and 514 may interfere with the spacer ribs 589 in the process of pulling-out of the basket 510.

Therefore, in the present embodiment, in order to prevent the side walls 513 and 514 of the basket 510 from interfering with the spacer ribs 589 in the process of pulling-out of the basket 510, each of the side walls 513 and 514 of the basket 510 may include a first wall 513*a* having a horizontal upper surface, an inclined wall 513*b* having an upper surface inclined downward as it goes backward from the first wall 513*a*, and a second wall 513*c* which extends rearward from the inclined wall 513*b* and has a horizontal upper surface.

The height of the second wall 513*c* may be equal to the minimum height of the inclined wall 513*b* and the height of the first wall 513*a* is equal to the maximum height of the inclined wall 513*b*. At this time, the inclination angle of the upper surface of the inclined wall 513*b* may be the same as the inclination angle of the inclined surfaces 541*b* and 542*b* of the guide rail 540.

Thus, according to the present embodiment, in a process of the pulling-in of the basket 510, the basket 510 may be stably moved to the fully inserted position by the inclined surfaces 541*b* and 542*b* of the guide rail 540. In addition, in a process of pulling-out of the basket 510, the basket 510 can be moved in a state of being kept horizontal without being inclined forward and backward by the inclining rib 518*d* and the inclined wall 513*b* and thus there is an advantage that stable pulling-out is possible.

Figure 13:
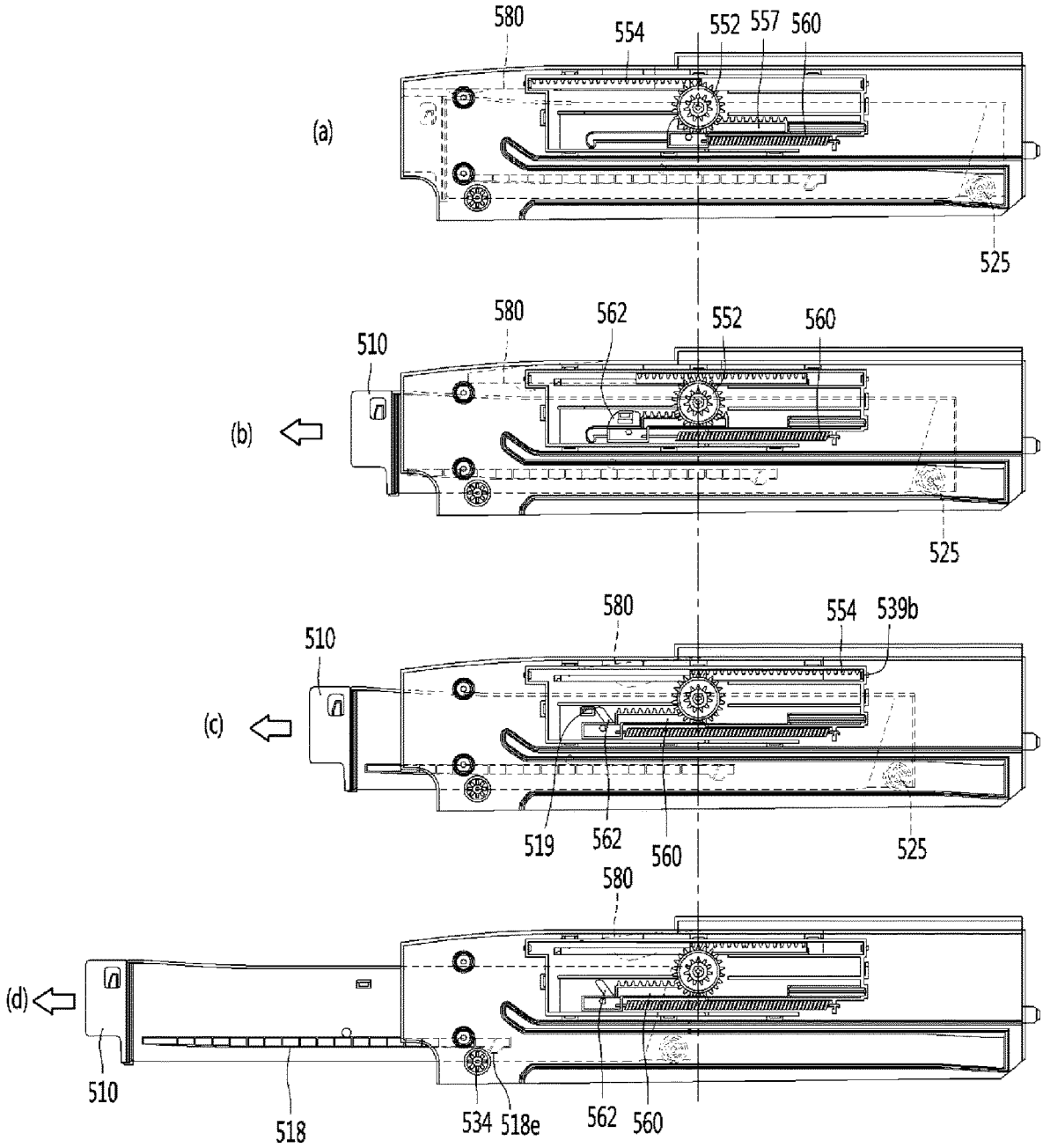
FIG. 13 illustrates a process of pulling out a receiving member according to an embodiment in stages.
Figure 14:
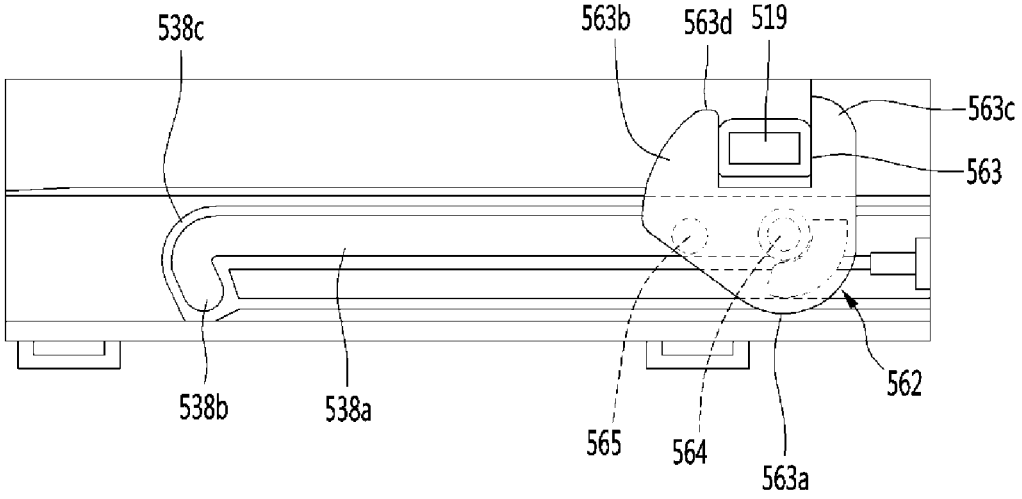
FIG. 14 illustrates a state of the connection member at a pulling-in completion position of the receiving member.
Figure 15:
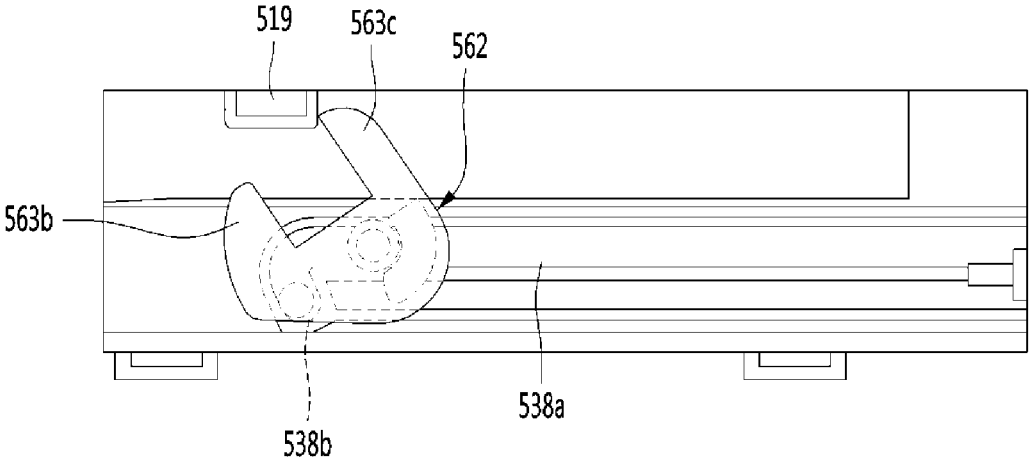
FIG. 15 illustrates a state where a connection member is rotated according to an embodiment.
Figure 16:
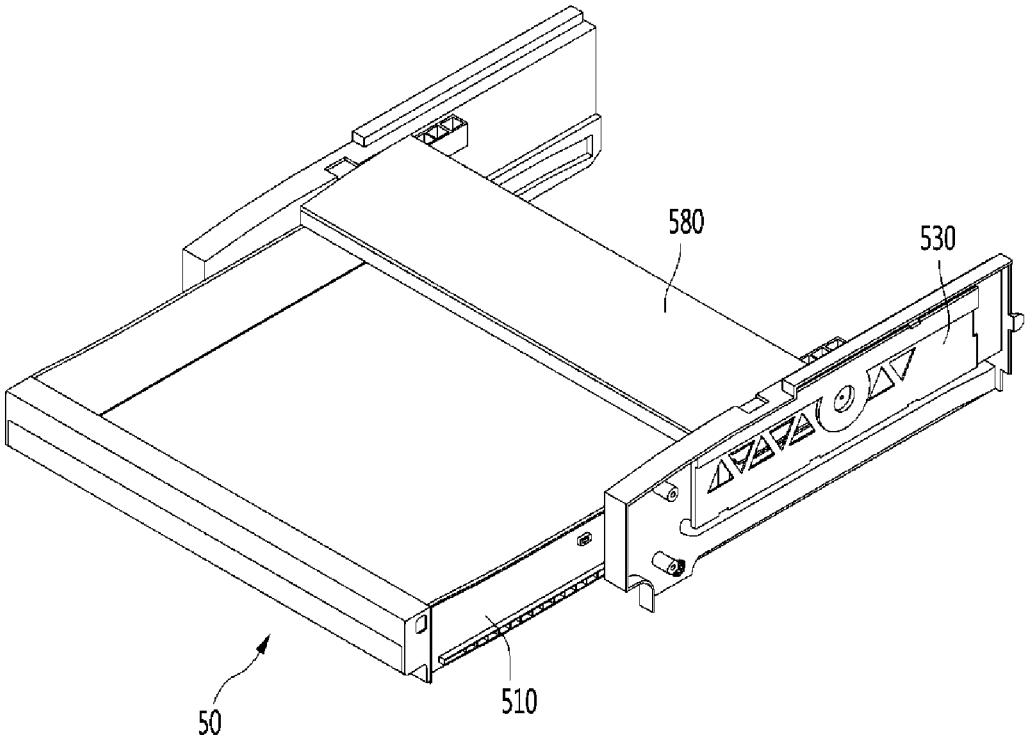
FIG. 16 is a perspective view illustrating a state where the receiving member has moved to the pulling-out completion position.

FIG. 13 (*a*) illustrates a state where the receiving member is located at the fully inserted position, and FIG. 13 (*b*) illustrates a state where the receiving member is pulled out by the first distance from the fully inserted position.

FIG. 13 (*c*) illustrates a state where the receiving member is pulled out by a second distance and the cover member has moved to the opening completion position, and FIG. 13 (*d*) illustrates a state where the receiving member has moved to the pulling-out completion position.

Referring to FIGS. 9 to 16, the transmission protrusion 519 of the receiving member 510 may be positioned at the notch 563 of the connection member 562 at the fully inserted position of the basket 510. The first protrusion 564 and the second protrusion 565 of the connection member 562 may be located in the first slot 538*a*. In this state, when the basket 510 is pulled toward the user to pull out the basket 510, as illustrated in FIG. 13 (*b*), the basket 510 may be moved linearly in the horizontal direction after being lifted to a predetermined height by the inclined surface 541*b* and 542*b* of the guide rail 540.

At this time, in a case where the first protrusion 564 and the second protrusion 565 of the connection member 562 are positioned in the first slot 538*a*, in the process of pulling-out of the basket 510, the rotation of the connection member 562 may be restricted and the connection member 562 may be linearly and moved stably. In a case where the connection member 562 linearly moves, the first rack 557 connected to the connection member 562 may linearly move in the first direction (arrow direction in FIG. 13).

When the first rack 557 moves in the first direction, the transmission gear 552 may be rotated in the clockwise direction in the drawing, and the rotation of the transmission gear 552 may cause the second rack 554 to be linearly moved in a second direction opposite to the first direction. Then, the cover 580 may move in the second direction together with the second rack 554, so that the basket 511 of the receiving member 510 is opened.

In the present embodiment, the upper surface of the transmission protrusion 519 may be positioned lower than the upper ends of the front body 563*b* and the rear body 563*c* forming the notch 563. The height of the front body 563*b* may be lower than the height of the rear body 563*c*. Therefore, the upper surface of the transmission protrusion 519 may be positioned lower than the upper end 563*d* of the front body 563*b*.

This is because the basket 510 may be lifted by the inclined surfaces 541*b* and 542*b* of the guide rail 540 at the initial pulling-out of the basket 510, so that the transmission protrusion 519 may be prevented from being separated from the notch 563. In addition, in order to prevent the transmission protrusion 519 from being separated, the upper surface of the transmission protrusion 519 may be positioned at a position lower than the upper end 563*d* of the front body 563*b* at a position in which the transmission protrusion 519 is lifted.

Therefore, even if the transmission protrusion 519 is lifted due to the lifting of the basket 510, the transmission protrusion 519 may be kept in a state where the transmission protrusion 519 is positioned at the notch 563, and thus the connection member 562 may be moved together when the transmission protrusion 519 is moved as illustrated in FIG. 13. In a process of pulling-out of the basket 510, the elastic member 580 may be tensioned to accumulate the elastic force. In other words, when the basket 510 is pulled out, the transmission protrusion 519 may be in contact with the front body 563*b* of the connection member 562 to push the front body 563*b* forward.

Referring to FIGS. 13 (*c*) and 14, when the second rack 554 is in contact with the stopper 539*b* in a process of pulling-out of the basket 510, the moving of the second rack 554 may be restricted, and the cover 580 may be stopped. In the present embodiment, the position of the cover 510 when the second rack 554 contacts the stopper 539*b* may be referred to as an opening completion position.

If the movement force of the basket 510 is continuously transmitted to the cover 580 in a state where the cover 580 is stopped, the transmission unit and/or the cover 580 may be broken. Therefore, the second protrusion 565 of the connection member 562 may be aligned with the second slot 538*b* just before the cover 580 is moved to the opening completion position and stopped. In this state, when the basket 510 is further pulled forward, the second protrusion 565 may be moved to the second slot 538*b*, and the connection member 562 may be rotated in this process.

The connection member 562 may be rotated around the rack coupling shaft 566. The guide slot may include a curved guide surface 538*c* which connects the first slot 538*a* and the second slot 538*b* to each other so that the second protrusion 565 may smoothly move into the second slot 538*b* in the first slot 538*a*.

When the connection member 562 is rotated, the height of the front body 563*b* of the connection member 562 may be lowered so that the front body 563*b* may be deviated from the moving path of the transmission protrusion 519. Therefore, the transmission protrusion 519 may continuously move in the first direction without interfering with the front body 563*b*. On the other hand, the moving force of the transmission protrusion 519 may no longer be transmitted to the connection member 562. Therefore, in a state where the cover 580 is stopped, the basket 510 may move in the first direction.

The elastic force of the elastic member 560 may act on the connection member 562 in a state where the second protrusion 565 is moved to the second slot 538*b*. The elastic member 560 may act as a force for pulling the connection member 562. The second slot 538*b* may be inclined downward from the front end portion of the first slot 538*a* toward the rear, although the elastic force of the elastic member 560 may act on the connection member 562 in a state where the second protrusion 565 is positioned to the second slot 538*b*, the connection member may be prevented from being rotated clockwise with reference to FIG. 13 by the elastic member 560.

Referring to FIG. 13 (*d*), when the cover 580 is stopped, the basket 510 may be continuously pulled out in the first direction. The pulling-out of the basket 510 may be restricted by a pulling-out restricting portion 518*e* provided in the basket 510 in a process of pulling out the basket 510.

The position at which the pulling-out of the basket 510 is restricted and thus the basket 510 is stopped is the pulling-out completion position. For example, the pulling-out restricting portion 518*e* may be provided on the guide protrusion 518. The pulling-out restricting portion 518*e* may protrude downward from the rear end portion of the lower rib 518*a*.

The pull-out restricting portion 518*e* may be in contact with the second roller 534 of the supporter 530 at the pull-out completion position. The pulling-out restricting portion 518*e* may have a curved surface for surface contact with the second roller 534 so that the basket 510 may be kept a state of being stopped at the pull-out completion position.

Referring to FIGS. 9 to 17, the basket 510 may be pushed to be moved in the second direction so that the basket 510 which is moved to the pulling-out completion position is pulled in. Since the transmission protrusion 519 of the basket 510 is deviated from the space portion 563 of the connection member 562 at the beginning of the pulling-in of the basket 510, the connection member 562 may keep a state of being stopped at the time of moving of the basket 510. In other words, the cover 580 may remain stopped at the opening completion position.

Figure 17:
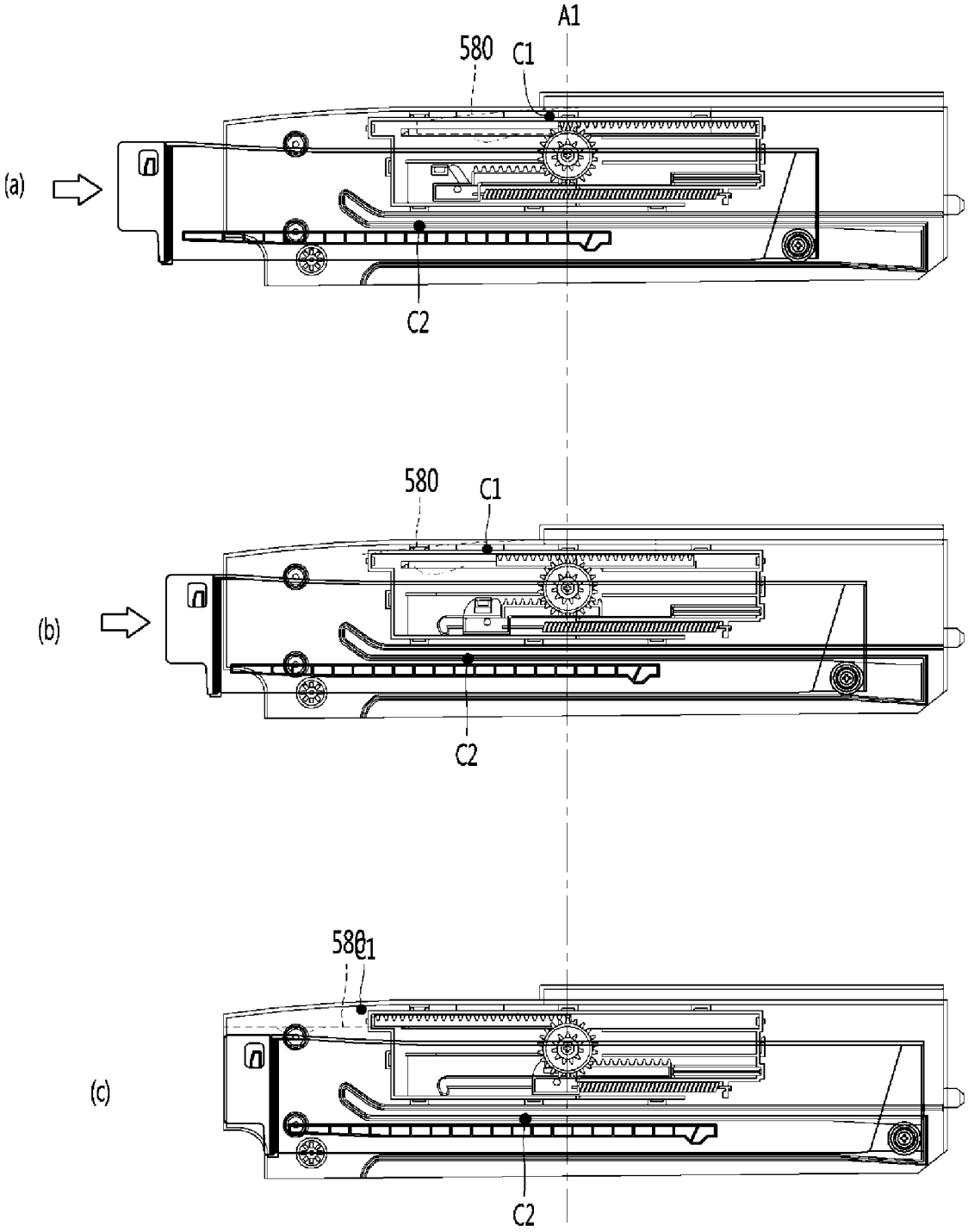
FIG. 17 illustrates a relative position between the center of gravity of the receiving member and the center of gravity of the cover member.
Figure 18:
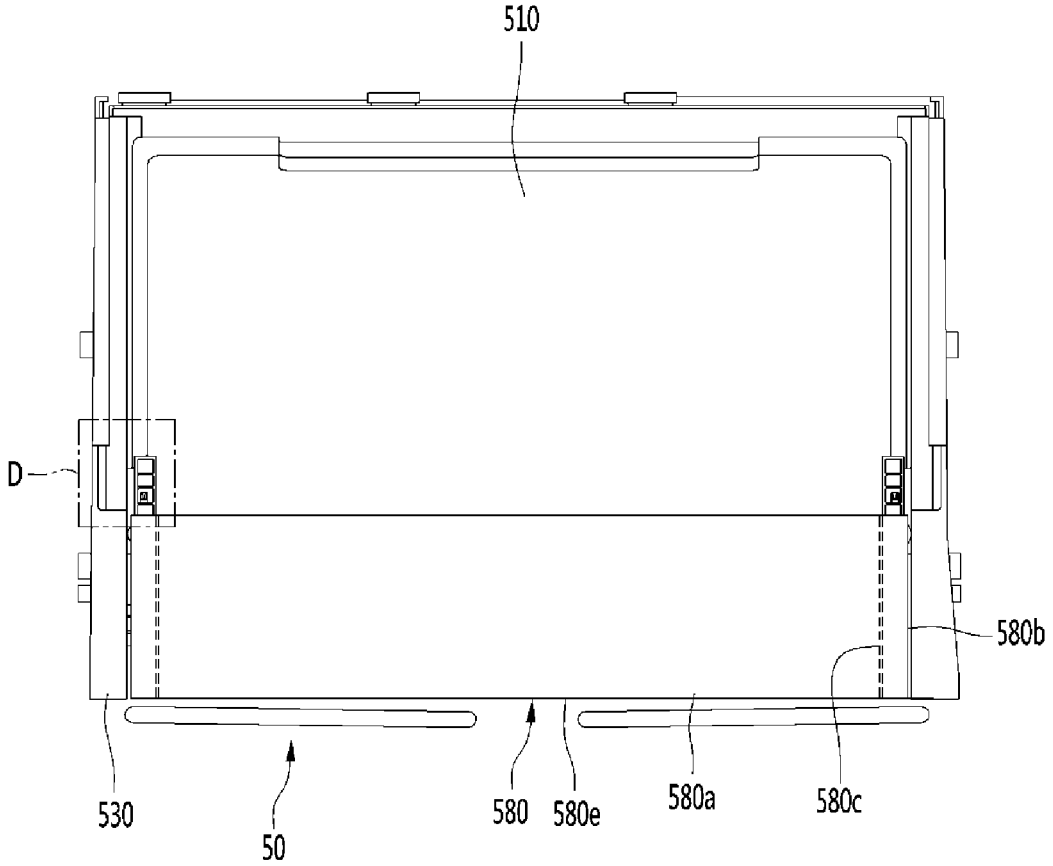
FIG. 18 is a plan view illustrating a pantry assembly according to an embodiment.
Figure 19:
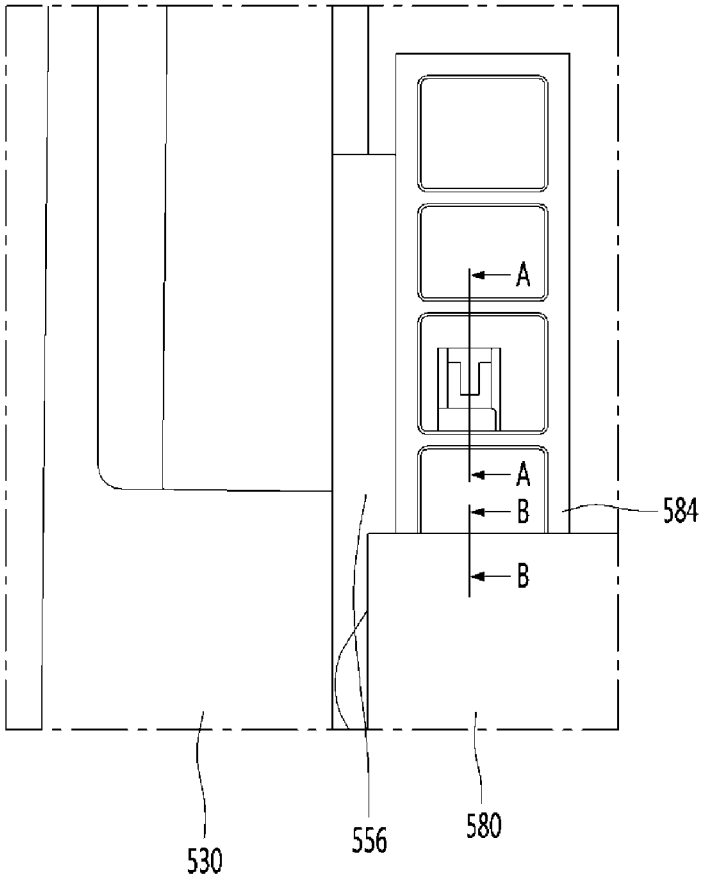
FIG. 19 is an enlarged view of FIG. 18.
Figure 20:
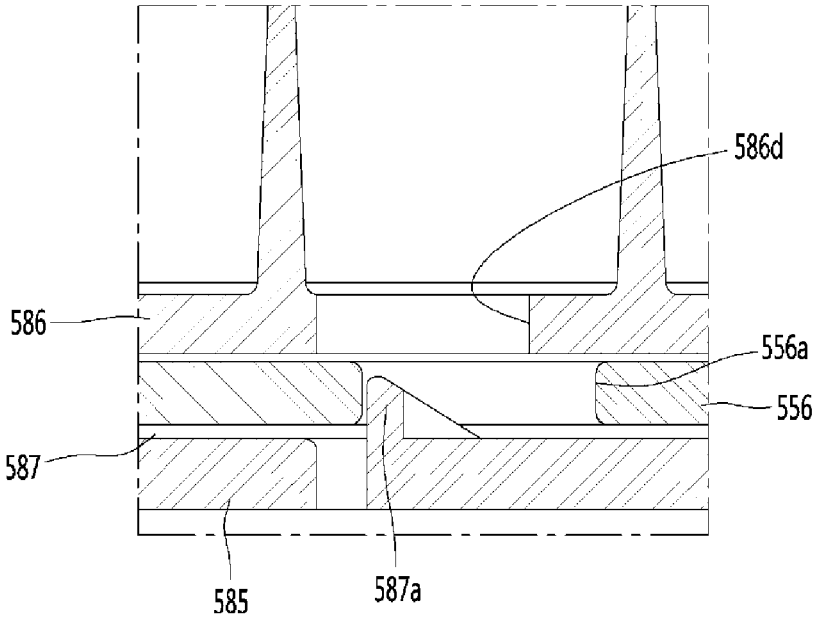
FIG. 20 is a sectional view taken along line A-A in FIG. 19.
Figure 21:
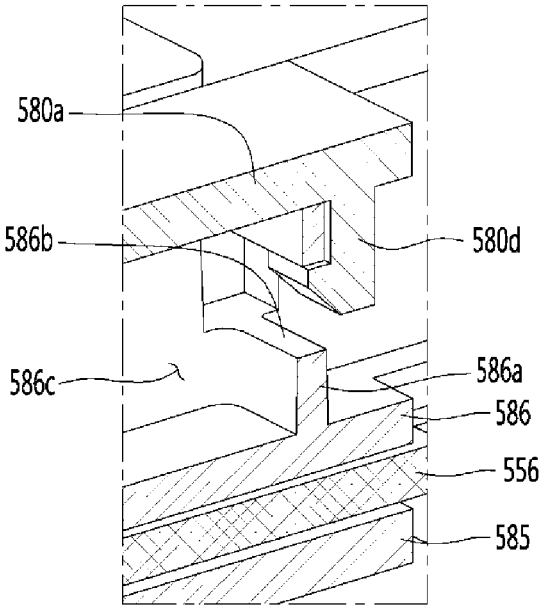
FIG. 21 is a sectional view taken along line B-B of FIG. 19.

Next, as illustrated in FIG. 17 (*a*), the transmission protrusion 519 may be in contact with the rear body 563*c* of the connection member 562 in a process in which the basket 510 is pulled in. As illustrated above, since the height of the rear body 563*c* may be higher than the height of the front body 563*b*, even if the connection member 562 is rotated in the process of pulling-out of the basket 510, the rear body 563*c* may be located on the path of the transmission protrusion 519.

Accordingly, as illustrated in FIG. 17 (*b*), when the transmission protrusion 519 pushes the rear body 563*c* backward, the connection member 562 may be rotated in the clockwise direction in the drawing, and the transmission protrusion 519 may be positioned in the notch 563 of the connection member 562. In this state, when the basket 510 is continuously pushed in, the transmission protrusion 519 may push the rear body 563*c*, so that the connection member 562 is moved in the second direction together with the basket 510.

Then, the first rack 557 may move together with the connection member 562 in the second direction, and the transmission gear 552 may be rotated counterclockwise in the drawing. As the transmission gear 552 rotates, the second rack 554 may linearly move in the first direction. Then, the cover 580 may move in the first direction together with the second rack 554 to close the receiving space 511 of the basket 510.

When the basket 510 rotates the connection member 562 so that the second protrusion 565 of the connection member 562 is moved to the first slot 538*a* in the second slot 538*b*, the elastic force of the elastic member 560 may act on the connection member 562 through the first rack 557. Then, since the elastic force of the elastic member 560 may be transmitted to the basket 510, although the user removes the force pushing the basket 510, the basket 510 may be automatically moved toward the fully inserted position by the elastic force of the elastic member 560.

When the first roller 525 meets the inclined surfaces 541*b* and 542*b* of the guide rail 540 while the basket 510 is automatically slid along the fully inserted position, the basket 510 may move to the fully inserted position while the basket 510 is lowered by the inclined surface 541*b* and 542*b*. At this time, the inclined surfaces 541*b* and 542*b* may automatically move the basket 510 to the fully inserted position even if there is no force to push the basket 510.

Meanwhile, referring to FIG. 17 (*c*), the center of gravity C2 of the basket 510 and the center of gravity C1 of the cover 580 at the pulling-in completion position of the basket 510 may be located forward of the imaginary line A1 passing the rotation shaft of the transmission gear 552 vertically. The center of gravity C2 of the basket 510 may be located closer to the imaginary line A1 than the center of gravity C1 of the cover 580 at the pulling-in completion position of the basket 510.

Referring to FIG. 17 (*b*), at the time when the first roller 525 of the basket 510 is in contact with the inclined surfaces 541*b* and 542*b* of the guide rail 540 in the process of pulling-in of the basket 510, the center of gravity C2 of the basket 510 and the center of gravity C1 of the cover 580 may be located forward of the imaginary line A1. At the time when the first roller 525 of the basket 510 is in contact with the inclined surfaces 541*b* and 542*b* of the guide rail 540, the center of gravity C2 of the basket 510 may be located forward of the center of gravity C1 of the cover 580.

Referring to FIG. 17 (*a*), when the cover 580 is moved to the opening completion position, the center of gravity C2 of the basket 510 and the center of gravity C1 of the cover 580 may be positioned forward of the imaginary line A1 passing the rotation shaft of the transmission gear 552 vertically. The center of gravity C2 of the basket 510 may be located forward of the center of gravity C1 of the cover 580 in a state where the cover 580 is moved to the opening completion position.

In this state, the horizontal distance between the center of gravity C1 of the cover 580 and the imaginary line A1 in the front and rear direction may be shorter than the radius of the transmission gear 552 (for example, the radius of the second gear).

Referring to FIGS. 18 to 21, the connection frame 584 may be coupled to the cover 580. The connection frame 584 may be detachably coupled to the second rack 554 in a state where the connection frame 584 is coupled to the cover 580. Therefore, the cover 580 may be separated from the pantry assembly 50 in a state where the pantry assembly 50 is installed in the inner case 101.

The cover 580 may include an upper wall 580*a*, a pair of outer walls 580*b* extending downward from both ends of the upper wall 580*a*, and a front wall 580*e* extending downward from the front end of the upper wall 580*a*. The front wall 580*e* may connect the pair of outer walls 580*b* to each other.

The cover 580 may further include a pair of inside walls 580*c* spaced apart from each of the pair of outside walls 580*b* between the pair of outside walls 580*b*. Each of the inside walls 580*c* may extend downward from the lower surface of the cover member 580. The connection frame 584 may be received in a space between the inside wall 580*c* and the outside wall 580*b*.

The connecting frame 584 may include a rib receiving slot 587 for receiving the cover coupling rib 556 of the second rack 554. The rib receiving slot 587 may have a predetermined length from the rear end portion of the connecting frame 584 toward the front end.

The connection frame 584 may be partitioned into an upper frame 586 and a lower frame 585 with reference to the rib receiving slot 587. The upper frame 586 may include a recessed portion (or recess) 586*c* formed by a portion of the upper surface thereof being recessed downward. The weight of the upper frame 586 may be reduced by the recessed portion 586*c*, and the strength thereof can be improved.

The recessed portion 586*c* may include a coupling wall 586*a* for coupling with the cover member 510. A coupling hole 586*b* may be formed in the coupling wall 586*a*. The upper surface wall 580*a* of the cover 580 may include a coupling hook 580*d* for coupling with the coupling wall 586*a*.

In a process in which the connection frame 584 is received in the space between the inner wall 580*c* and the outer wall 580*b*, the coupling hook 580*d* may be received in the recessed portion 586*c* and may be hooked to the coupling hole 580*b* of the coupling wall 586*a*. A hook hole 556*a* may be formed in the cover coupling rib 556 of the second rack 554 and the lower frame 585 may include a frame hook 587*a* for hooking the hook hole 556*a*.

In a process in which the cover coupling rib 556 is received in the rib receiving slot 587, when the frame hook 587*a* is hooked to the hook hole 586*a*, the coupling of the connection frame 584 and the second rack 554 may be completed. In the connection frame 584, the upper frame 586 may include an opening 586*d* aligned with the hook hole 586*a* in the vertical direction.

The user may press the frame hook 587*a* so that the frame hook 587*a* is separated from the hook hole 556*a* in a state where the tool is passed through the opening 586*d* from above the connecting frame 584. Then, the frame hook 587*a* may be disengaged from the hook hole 556*a* and thus the connecting frame 584 may be separated from the second rack 554. The connection frame 584 and the cover member 580 may be referred to as a cover unit.

According to this embodiment, there is an advantage that the receiving member may be automatically pulled in by the elastic member in a process in which the receiving member is moved from the pulling-out completion position to the pulling-in completion position and the receiving member can be automatically returned to the pulling-in completion position by the inclined surface of the guide rail. Therefore, there is an advantage that the elastic modulus of the elastic member may be reduced, and the force required for the pulling out of the receiving member may be reduced in a process of pulling out the receiving member.

In addition, according to the present embodiment, since the diameter of the first gear connected to the connection member in the transmission gear may be smaller than the diameter of the second gear connected to the cover member, there is an advantage that the sliding distance of the cover member compared to the pulling-out distance of the receiving member may be increased and thus the opening area of the receiving member may be increased. In addition, according to the present embodiment, since the guide protrusion provided on the side wall of the receiving member may include the inclined rib, when the height is changed by the inclined surface in a process in which the receiving member is pulled in and out, there is an advantage that the entire receiving member may be kept horizontal without being inclined.

In addition, in the present embodiments, since the connection frame may be connected to the cover member and the connection frame may be connected to the second rack of the transmission unit, in a process in which the cover member is operated to open and close the receiving space of the receiving member, the cover member may be prevented from being damaged. In addition, the gap between the cover member and the receiving member may be formed by the cover member or the spacer rib formed on the connection frame, so that cool air flow may be smooth, and in a state where the cover member covers the receiving space, a phenomenon in which the cover member tilts forward may be prevented.

A refrigerator may require less force when a basket is pulled out, and may easily return the basket to a pulling-in completion position when the receiving member is pulled in. This embodiment provides a refrigerator in which the sliding distance of the cover member with respect to the pulling-out distance of the basket may be increased to increase the opening area of the receiving member.

The present embodiment provides a refrigerator in which the entire basket may be kept in a horizontal state without being inclined when a height thereof is changed in a process in which the basket is pulled in and out. This embodiment provides a refrigerator in which the cover member may be prevented from being broken in a process of pulling-in and out the basket.

A refrigerator may include: a cabinet including an inner case forming a storage chamber; and a pantry assembly installed on both side walls of the inner case, in which the pantry assembly includes a receiving member which forms a receiving space and can be pulled in and out from the storage chamber; a supporter assembly connected to the receiving member and guiding the pulling-in and out of the receiving member; and a cover member which is connected to the supporter assembly, covers the receiving space, and moves in a direction opposite to the receiving member when the receiving member is pulled in and out. The receiving member may include a first roller rotatably installed on both side walls of the receiving member.

The supporter assembly may include a supporter having a guide rail for forming a space for receiving the first roller, and a transmission unit installed on the supporter and transmitting the movement force of the receiving member to the cover member. The transmission unit may include an elastic member which provides an elastic force to the receiving member for automatic pulling-in of the receiving member in a process of pulling in the receiving member.

The transmission unit may include a connection member connected to the transmission protrusion of the receiving member, a first rack connected to the connection member, a transmission gear engaged with the first rack, and a second rack connected to the transmission gear and connected to the cover member. The transmission gear may include a first gear and a second gear having a diameter which is larger than a diameter of the first gear. The first rack may include a first rack gear portion engaged with the first gear at a lower side of the first gear, and the second rack may include a second rack gear portion engaged with the second gear at an upper side of the second gear.

The length of the second rack gear portion may be longer than the length of the first rack gear portion. The second rack may include a cover coupling rib which is connected to the connecting frame and includes a hook hole. The connecting frame may include a slot for receiving the cover coupling rib and a frame hook for hooking the hook hole of the cover coupling rib received in the slot.

The connection frame may further include an opening aligned with the hook hole in the vertical direction. The cover member may include a coupling hook extending downward, and the connection frame may include a coupling wall having a coupling hole for coupling the coupling hook. The guide rail may include a first guide portion, and a second guide portion positioned above the first guide portion and forming the space together with the first guide portion.

The first roller may be supported by the first guide portion in a state where the first roller is received in a space of the guide rail, and the first guide portion may include an inclined surface inclined so that the receiving member is lowered in a process of the pulling in the receiving member. The second guide portion may include an inclined surface inclined at the same angle as the inclined surface of the first guide portion. The guide rail may further include a connection portion connecting an inclined surface of the first guide portion and an inclined surface of the second guide portion.

In the present embodiment, the first roller may be in contact with the inclined surface of the first guide portion before the receiving member is moved to the pulling-in completion position. In the present embodiment, the receiving member may further include guide protrusions protruding from both side walls and extending in the front and rear direction of the receiving member. The supporter may further include a second roller for supporting the guide protrusion, and the guide protrusion may include an inclined rib with which the second roller is in contact when the first roller is in contact with the inclined surface of the first guide portion.

The inclined angle of the inclined rib may be the same as the inclined surface of the first guide portion. In the present embodiment, the guide protrusion may include a lower rib, an upper rib spaced apart from the lower rib, and a plurality of connection ribs connecting the lower rib and the upper rib with each other. The lower rib may include the inclined rib. The inclined rib may be connected to the front end portion of the upper rib.

In the present embodiment, it may further include a connection frame connected to both sides of the cover member, and a transmission unit connected to the connection frame and transmitting the movement force of the receiving member to the cover member. At least one of the cover member and the connection frame may include a spacer rib so that a gap exists between the cover member and the receiving member.

In the present embodiment, the spacer ribs may extend downward from at least one of the cover member and the connection frame, and may be seated on the upper surfaces of the side walls on both sides of the receiving member, respectively. Each of the side walls of the receiving member may include a first wall having a horizontal upper surface, an inclined wall having an upper surface inclined downwardly from the first wall toward the rear side, and a second wall extending from the inclined wall toward the rear and having a horizontal upper surface.

When the first roller is in contact with the inclined surface of the first guide portion, the spacer rib may be in contact with the inclined wall. The inclination angle of the upper surface of the inclined wall may be the same as the inclined surface of the first guide portion. The receiving member may include a transmission protrusion connected to the transmission unit.

The receiving member may move between the pulling-in completion position and the pulling-out completion position. The cover member may be moved to the opening completion position before the receiving member is moved from the pulling-in completion position to the pulling-out completion position.

The horizontal distance between the center of gravity of the cover member and an imaginary line A1 passing vertically through the rotation shaft of the transmission gear at the opening completion position of the cover member may be shorter than the radius of the second gear. At the pulling-in completion position of the receiving member, the imaginary line A1 passing vertically through the rotation shaft of the transmission gear may be positioned closer to the front end than the rear end of the pantry assembly.

When the first roller is in contact with the inclined surface in a process of moving the receiving member from the pulling-out completion position to the pulling-in completion position, the center of gravity C2 of the receiving member and the center of gravity C1 of the cover member may be positioned in front of the imaginary line A1. The center of gravity C2 of the receiving member 510 may be positioned forward of the center of gravity C2 of the cover member 580 when the first roller is in contact with the inclined surface.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including an inner case; and a drawer assembly installed in the inner case, wherein the drawer assembly includes:

a basket that forms a receiving space, the basket being configured to be inserted and withdrawn from the inner case;

a supporter assembly connected to the basket, the supporter assembly configured to guide a movement of the basket; and a cover connected to the supporter assembly, the cover covering the receiving space in a first position, and the cover being configured to move in a direction opposite to a moving direction of the basket when the basket is withdrawn or inserted, wherein the basket includes at least one first roller rotatably installed on both side walls of the basket, wherein the supporter assembly includes:

at least one supporter including a guide rail configured to receive the at least one first roller, and a transmission assembly installed in the supporter and configured to transmit a moving force of the basket to the cover, and wherein the transmission assembly includes:

an elastic member that provides an elastic force to the basket to pull the basket to an inserted position, wherein the basket includes a protrusion configured to engage with the transmission assembly, wherein the transmission assembly further includes:

a connection hook configured to accept the protrusion of the basket, a first rack connected to the connection hook, a transmission gear operably engaged with the first rack, and a second rack operably engaged with the transmission gear and connected to the cover, wherein the transmission gear includes:

a first gear having a first diameter and engaged with the first rack; and a second gear having a second diameter larger than the first diameter and engaged with the second rack, the second gear having a rotational center that coincides with a rotational center of the first gear.

2. The refrigerator of claim 1, wherein the first rack includes a first rack gear having a first set of teeth engaged with the first gear and positioned under the first gear, and wherein the second rack includes a second rack gear having a second set of teeth engaged with the second gear and positioned above the second gear.

3. The refrigerator of claim 2, wherein a length of the second rack gear is longer than a length of the first rack gear.

4. The refrigerator of claim 2, wherein the basket is moveable between the inserted position and a withdrawn position, wherein the cover is moved to a second position different from the first position before the basket moves from inserted position to the withdrawn position, and wherein a horizontal distance between a rotation center of the transmission gear at the second position of the cover and a center of gravity of the cover is shorter than a radius of the second gear.

5. The refrigerator of claim 1, wherein the basket is moveable between an inserted position and a withdrawn position, and wherein, at the inserted position of the basket, a rotation center of the transmission gear is located horizontally closer to a front end than a rear end of the drawer assembly.

6. The refrigerator of claim 1, wherein the drawer assembly further includes a first connection frame connected to a first side of the cover and a second connection frame connected to a second side of the cover, wherein the second rack includes a cover coupling rib connected to at least one of the first or second connection frames and having a hook hole, and wherein at least one of the first or second connection frames includes:

a slot configured to receive the cover coupling rib, and a frame hook configured to be inserted into the hook hole of the cover coupling rib received in the slot.

7. The refrigerator of claim 6, wherein at least one of the first or second connection frames further includes an opening aligned with the hook hole in a vertical direction.

8. The refrigerator of claim 6, wherein the cover includes a coupling hook the extends downward, and wherein at least one of the first or second connection frames further includes a coupling wall including a coupling hole configured to receive the coupling hook.

9. The refrigerator of claim 1, wherein the guide rail includes:

a first guide rail, and a second guide rail positioned above the first guide rail and forming a groove together with the first guide rail, wherein the first roller is supported by the first guide rail when the first roller is received in the groove, and wherein the first guide rail includes an inclined surface which is inclined such that the basket is lowered at the inserted position.

10. The refrigerator of claim 9, wherein the second guide rail includes an inclined surface inclined at the same angle as the inclined surface of the first guide rail.

11. The refrigerator of claim 10, wherein the first guide rail and the second guide rail are connected to each other at a rear of the supporter.

12. The refrigerator of claim 9, wherein the first roller is in contact with the inclined surface of the first guide rail before the basket moves to the inserted position.

13. The refrigerator of claim 9, wherein the basket further includes guide protrusions that protrude outward from both side walls of the basket and extend in a lengthwise direction of the basket, wherein the supporter further includes a second roller configured to support at least one of the guide protrusions, and wherein at least one of the guide protrusions includes an inclined rib with which the second roller is in contact when the first roller is in contact with the inclined surface of the first guide rail.

14. The refrigerator of claim 13, wherein the inclined rib is inclined at the same angle as the inclined surface of the first guide rail.

15. The refrigerator of claim 14, wherein at least one of the guide protrusions includes:

a lower rib;

an upper rib positioned above the lower rib and spaced apart from the lower rib; and a plurality of connection ribs that connect the lower rib and the upper rib with each other, wherein the lower rib includes the inclined rib, and wherein a front end of the inclined rib is connected to a front end of the upper rib.

16. The refrigerator of claim 9, wherein the drawer assembly further includes a first connection frame connected to a first side of the cover and a second connection frame connected to a second side of the cover, and wherein at least one of the cover and the first or second connection frame includes a spacer rib that creates a gap between the cover and the basket.

17. The refrigerator of claim 16, wherein the spacer rib protrudes downward from at least one of the cover or the first or second connection frame and is seated on an upper surface of each of the side walls on both sides of the basket.

18. The refrigerator of claim 17, wherein each of the side walls of the basket includes:

a first wall having a horizontal upper surface;

an inclined wall having an upper surface which is inclined downward from the first wall toward a rear of the basket; and a second wall that extends toward the rear of the basket from the inclined wall and has a horizontal upper surface, and wherein the spacer rib is in contact with the inclined wall when the first roller is in contact with the inclined surface of the first guide rail.

19. The refrigerator of claim 18, wherein an angle of the upper surface of the inclined wall is the same as the angle of the inclined surface of the first guide rail.

20. The refrigerator of claim 9, wherein the basket is moveable between an inserted position and a withdrawn position, and wherein, when the first roller is in contact with the inclined surface of the first guide rail when the basket is in the inserted position, the center of gravity C2 of the basket and the center of gravity C1 of the cover are located horizontally forward of the rotation center of the transmission gear.

21. The refrigerator of claim 20, wherein, when the first roller is in contact with the inclined surface of the first guide rail, the center of gravity C2 of the basket is located forward of the center of gravity C1 of the cover.

22. A refrigerator comprising:

a cabinet including an inner case; and a drawer assembly installed in the inner case, wherein the drawer assembly includes:

a basket that forms a receiving space, the basket being configured to be inserted and withdrawn from the inner case;

a supporter assembly connected to the basket, the supporter assembly configured to guide movement of the basket; and a cover connected to the supporter assembly, the cover covering the receiving space in a first position, and the cover being configured to move in a direction opposite to a moving direction of the basket when the basket is withdrawn or inserted from the inner case, wherein the basket includes at least one first roller rotatably installed on both side walls of the basket, wherein the supporter assembly includes:

at least one supporter including a guide rail configured to receive the at least one first roller, and a transmission assembly installed at the supporter and configured to transmit a moving force of the basket to the cover, and wherein the transmission assembly includes:

an elastic member that provides an elastic force to the basket to pull the basket to an inserted position, wherein the basket includes a protrusion configured to engage with the transmission assembly, wherein the transmission assembly includes:

a connection hook configured to accept the protrusion of the basket, a first rack connected to the connection hook, a transmission gear operably engaged with the first rack, and a second rack operably engaged with the transmission gear and connected to the cover, wherein the basket is moveable between the inserted position and a withdrawn position, and wherein, at the inserted position of the basket, a rotation center of the transmission gear is located horizontally closer to a front end of the drawer assembly than a rear end of the drawer assembly.

* * * * *